US007640966B2

(12) United States Patent
Maeda et al.

(10) Patent No.: US 7,640,966 B2
(45) Date of Patent: Jan. 5, 2010

(54) HEAT EXCHANGER AND COOLING MODULE HAVING THE SAME

(75) Inventors: Akihiro Maeda, Kariya (JP); Yoshihiko Kamiya, Takahama (JP); Harumi Okai, Kariya (JP); Noriaki Maeda, Kariya (JP); Masami Tamura, Chita-gun (JP)

(73) Assignee: DENSO Corporation, Kariya (JP)

( * ) Notice: Subject to any disclaimer, the term of this patent is extended or adjusted under 35 U.S.C. 154(b) by 445 days.

(21) Appl. No.: 11/005,571

(22) Filed: Dec. 6, 2004

(65) Prior Publication Data

US 2005/0121170 A1 Jun. 9, 2005

(30) Foreign Application Priority Data

Dec. 9, 2003 (JP) ..... 2003-410908

(51) Int. Cl.
*B60H 1/00* (2006.01)

(52) U.S. Cl. ..... 165/41; 165/67; 165/76; 180/68.4

(58) Field of Classification Search ..... 165/41–44, 165/67, 76; 180/68.4, 68.6
See application file for complete search history.

(56) References Cited

U.S. PATENT DOCUMENTS

| | | | | |
|---|---|---|---|---|
| 5,219,016 | A * | 6/1993 | Bolton et al. | 165/41 |
| 5,269,367 | A * | 12/1993 | Susa et al. | 165/41 |
| 5,474,121 | A * | 12/1995 | Bryson et al. | 165/41 |
| 5,613,550 | A | 3/1997 | Ashida et al. | |
| 5,671,803 | A * | 9/1997 | Tepas et al. | 165/41 |
| 6,105,660 | A * | 8/2000 | Knurr | 165/41 |
| 6,158,500 | A * | 12/2000 | Heine | 165/67 |
| 6,216,810 | B1 * | 4/2001 | Nakai et al. | 180/68.4 |
| 6,237,676 | B1 * | 5/2001 | Hasegawa et al. | 165/67 |
| 6,470,961 | B1 * | 10/2002 | Case | 165/78 |
| 6,607,025 | B2 * | 8/2003 | Gille | 165/140 |
| 6,619,380 | B1 * | 9/2003 | Hartman et al. | 165/71 |
| 6,684,937 | B2 * | 2/2004 | Lenz et al. | 165/41 |
| 6,705,387 | B2 | 3/2004 | Kokubunji et al. | |
| 6,772,982 | B2 * | 8/2004 | Nakagawa et al. | 248/232 |
| 6,827,129 | B2 * | 12/2004 | Ozawa et al. | 165/67 |
| 6,997,239 | B2 * | 2/2006 | Kato | 165/41 |
| 7,121,369 | B2 * | 10/2006 | Beck et al. | 180/68.4 |
| 7,150,335 | B2 * | 12/2006 | Sasano et al. | 180/68.4 |
| 2001/0008183 | A1 * | 7/2001 | Ito et al. | 165/43 |
| 2001/0042611 | A1 * | 11/2001 | Ozaki et al. | 165/67 |

FOREIGN PATENT DOCUMENTS

JP 07238833 A * 9/1995

(Continued)

OTHER PUBLICATIONS

Mashio, Katsushi; JP-07-238833 A; Sep. 1995; English translation of Japanese patent, pp. 1-6.*

(Continued)

*Primary Examiner*—Ljiljana (Lil) V Ciric
(74) *Attorney, Agent, or Firm*—Harness, Dickey & Pierce, PLC

(57) ABSTRACT

An object of the invention is to provide a heat exchanger (radiator) or a cooling module having the radiator and a condenser, which has a higher rigidity against vibration in the vertical direction. To the end, the radiator or the cooling module is mounted to a vehicle by mounting brackets, which are fixed to the radiator tanks at their vertical ends. The mounting brackets have mounting pins, with which the radiator or the cooling module is mounted to the vehicle.

7 Claims, 16 Drawing Sheets

FOREIGN PATENT DOCUMENTS

| | | | | |
|---|---|---|---|---|
| JP | 11029069 | A | * | 2/1999 |
| JP | 11129934 | A | * | 5/1999 |
| JP | 11142084 | A | * | 5/1999 |
| JP | 11142084 | A | * | 5/1999 |
| JP | 2000072034 | A | * | 3/2000 |
| JP | 2000-280730 | | | 10/2000 |
| JP | 2001122156 | A | * | 5/2001 |
| JP | 2002-139288 | | | 5/2002 |
| JP | 2002-168588 | | | 6/2002 |
| JP | 2002168588 | A | * | 6/2002 |
| JP | 2003-65694 | | | 3/2003 |

OTHER PUBLICATIONS

Igami, Takashi; JP-2002-168588A; Jun. 2002; English translation of Japeanese patent, pp. 1-4.*

Sugimoto et al; JP-11-142084A; May 1999; English translation of Japanese patent, pp. 1-4.*

Office Action dated Dec. 15, 2006 in Chinese Application No. 200410098394.5 with English translation.

Office Action dated Nov. 16, 2007 in Chinese Application No. 200410098394.5 with English translation.

Office Action dated Apr. 11, 2008 in Chinese Application No. 2004 10098394.5 with English translation.

* cited by examiner

HEAT EXCHANGER AND COOLING MODULE HAVING THE SAME

CROSS REFERENCE TO RELATED APPLICATION

This application is based on Japanese Patent Application Nos. 2003-410908 filed on Dec. 9, 2003 and 2004-332402 filed on Nov. 16, 2004, the disclosures of which are incorporated herein by reference.

FIELD OF THE INVENTION

This invention relates to a heat exchanger or a cooling module having the same, wherein the heat exchanger is used, for example, as a radiator for cooling down an engine cooling water for an internal combustion engine, or as a condenser for condensing refrigerant for a refrigerating cycle.

BACKGROUND OF THE INVENTION

It is known in the art, for example, as disclosed in Japanese Patent Publication No. 2003-65694, that a heat exchanger comprises a core portion having multiple tubes and fins, which are alternately stacked in a vertical direction, a pair of reinforcing elements (side plates) provided at both vertical sides of the core portion, and mounting brackets fixed to the reinforcing elements for mounting the heat exchanger into an engine compartment of a vehicle.

In the above prior art, the mounting bracket has a U-shape in its cross-section and opening to the reinforcing elements. A projection is formed on a flat bottom portion (first wall portion) of the mounting bracket. The mounting bracket has a pair of downwardly bent wall portions (second wall portions) formed with multiple mounting holes. Multiple mounting bolts are inserted through the mounting holes and fixing holes formed in the reinforcing elements, to fix the mounting brackets to the reinforcing elements by screwing the mounting bolts.

In this prior art, a lower rigidity portion (thin-walled portion) is formed in the mounting bracket adjacent to the mounting holes, so that the pair of the second wall portions are easily bent inwardly toward the reinforcing elements without a large screwing force. As a result, the second wall portions become in contact with the reinforcing elements and the mounting brackets are firmly fixed to the reinforcing elements.

When a vibration in the vertical direction is applied to the heat exchanger from the vehicle, the reinforcing elements as well as tubes and fins (which are horizontally extending) of the prior art are likely to be bent in the vertical direction. And stress generating at the reinforcing elements, at which the mounting brackets are fixed, becomes larger. As a result, it is necessary in the prior art, to form the reinforcing elements having a higher rigidity.

SUMMARY OF THE INVENTION

The present invention is made in view of the above problems, and it is an object of the present invention to provide a heat exchanger and a cooling module for a vehicle, which comprises a core portion of horizontally extending tubes and fins, which is mounted into an engine compartment of the vehicle by mounting brackets, and which has a high vibration proof.

According to one of features of the present invention, a heat exchanger comprises; a pair of tanks made of a metal; multiple female screw nut portions provided in the tanks; and a core portion having multiple tubes and fins alternately stacked in a vertical direction, wherein both side ends of the tubes are connected to the tanks so that fluid flows from one of the tanks to the other tank through the multiple tubes. In the heat exchanger, multiple mounting brackets are fixed to the tanks by fixing means (such as bolts) screwed into the female screw nut portions provided in the tanks, and multiple mounting pins are formed in the brackets, with which the heat exchanger is mounted to a vehicle.

According to the above feature, since a vibration from the vehicle in the vertical direction is transmitted through the multiple mounting brackets to the tanks, which have a higher rigidity, the heat exchanger has a higher vibration proof performance.

According to another feature of the present invention, the female screw nut portion comprises; a cylindrical portion made of a metal; and a screw element screwed into the inside of the cylindrical portion, wherein the screw element is made of a different metal from the cylindrical portion and has a breaking force higher than that of the cylindrical portion.

As a result, a number of screw heads can be reduced to achieve a size down of the female screw nut portions.

According to a further feature of the present invention, the present invention can be also applied to a cooling module having a radiator and a radiator fan device. In the cooling module, a shroud of the radiator fan device is divided into two parts in the vertical direction, each having a mounting portion fixed to the radiator at female screw nut portions provided in the tanks of the radiator. The mounting portions further have multiple mounting pins, which are formed adjacent to the female screw nut portions, and with which the cooling module is mounted to the vehicle.

According to the above feature, the mounting portions of the shroud are fixed to the tanks of the radiator, which have a higher rigidity, and thereby the cooling module has a higher vibration proof performance.

Furthermore, other portions of the shroud than those portions, at which the shroud is fixed to the tanks and the mounting pins are formed, can be made of thin-walled portions to achieve a light weight of the shroud.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1A:
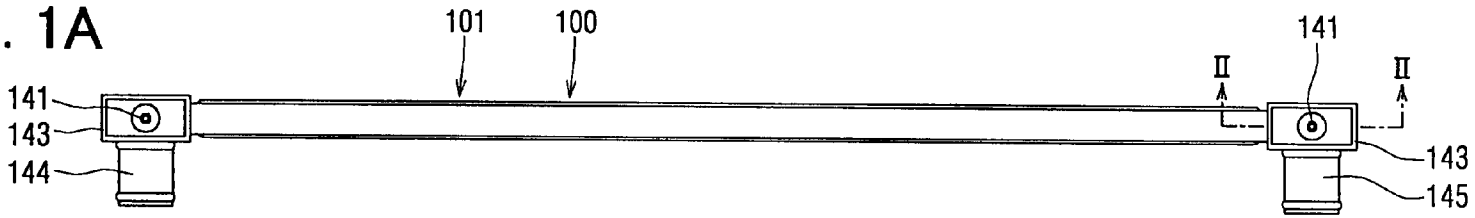
FIGS. 1A and 1B are respectively a top plan view and a front view of a radiator according to a first embodiment of the present invention.
Figure 1B:
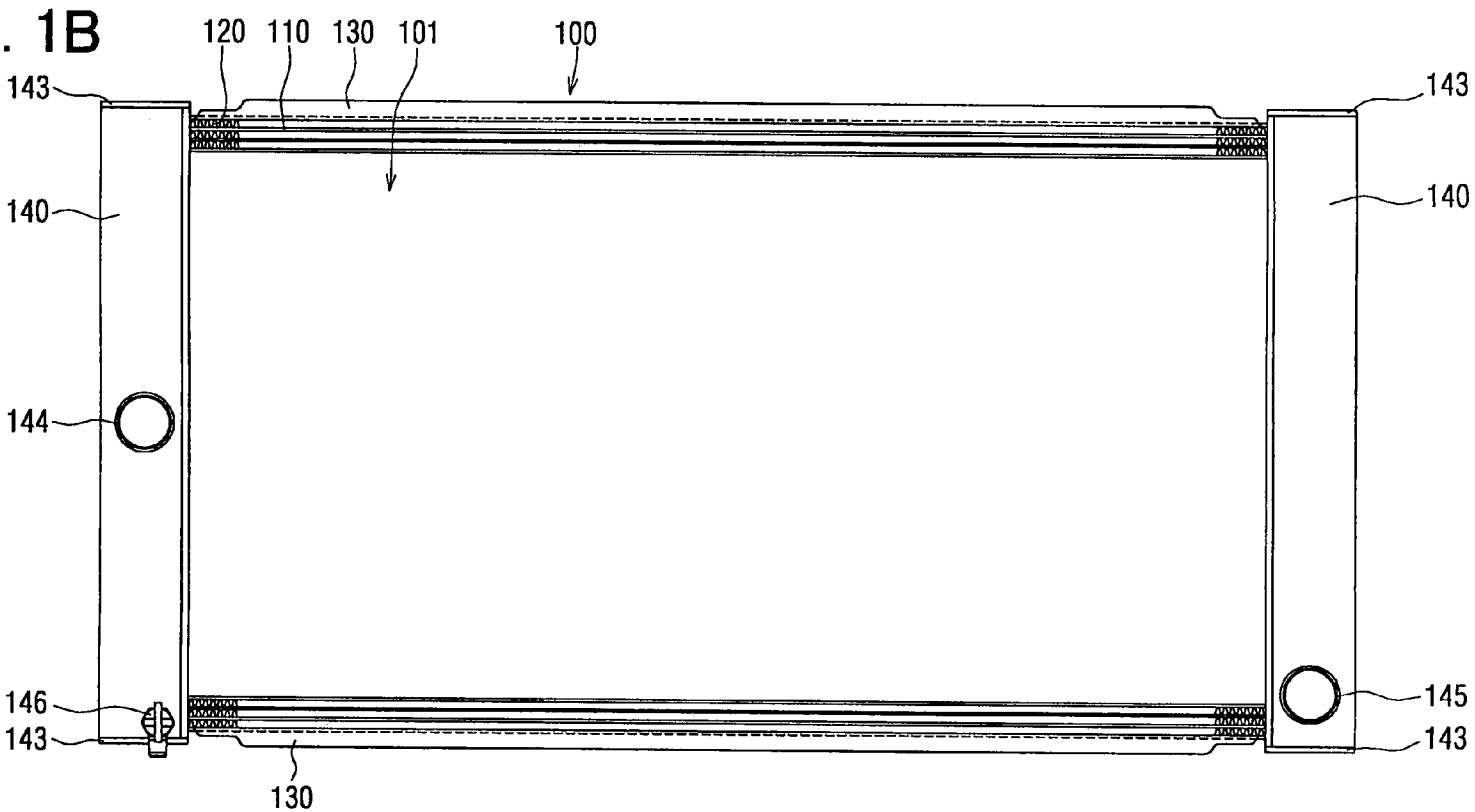
Figure 2:
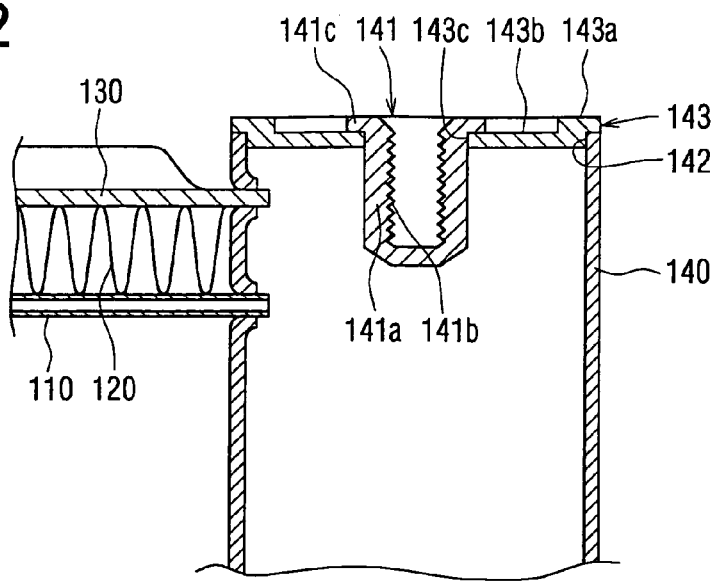
FIG. 2 is a cross-sectional view taken along a line II-II in FIG. 1.
Figure 3:
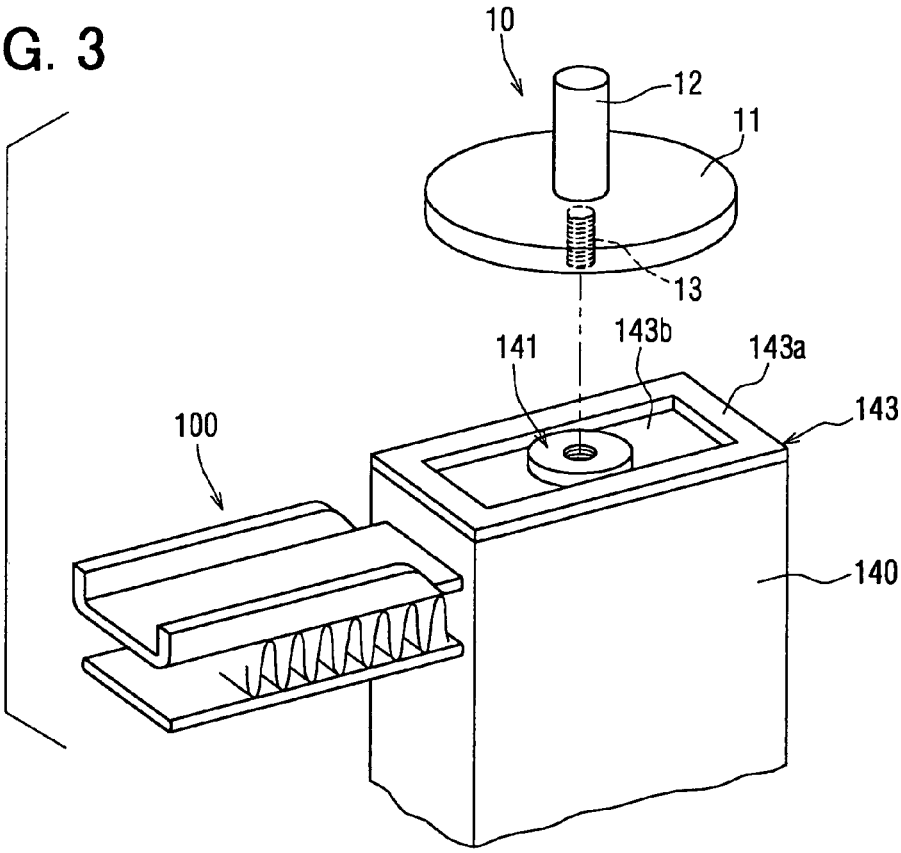
FIG. 3 is an exploded perspective view showing a bracket according to the first embodiment.

A first embodiment of the present invention will be explained below with reference to FIGS. 1 to 3. FIGS. 1A and 1B are a top plan view and a front view showing a heat exchanger, FIG. 2 is a cross sectional view taken along a line II-II in FIG. 1A, and FIG. 3 is a perspective view showing a mounting bracket to be assembled to a radiator tank.

A heat exchanger 100 in the first embodiment is a radiator for cooling down an engine cooling water for an internal combustion engine. The radiator 100 is an aluminum type radiator comprising multiple tubes 110, multiple fins 120, a pair of radiator tanks 140 and so on, wherein those elements are made of aluminum or aluminum alloy and assembled and integrally fixed to each other by brazing.

The radiator 100 is a cross-flow type heat exchanger, in which the multiple tubes 110 are horizontally arranged, and comprises a core portion 101 and the pair of the radiator tanks 140. In the core portion 101, the multiple tubes 110 and the multiple fins 120 are alternately stacked and a pair of side plates 130 of a U-shape in its cross section are provided at respective outermost fins 120 in its stacking direction. The stacking direction in this embodiment is a vertical direction. Further, in this embodiment, the side plates 130 serve as reinforcing members, and the core portion 101 operates as a heat radiating portion for cooling down the engine cooling water.

Each of the tanks 140 is formed from a pair of L-shaped metal plates, which are connected to each other to form a tubular tank having a rectangular cross section. Both of open ends (vertical ends) 142 of the tanks 140 are closed by caps members 143. The pair of tanks 140 are arranged that the longitudinal directions of the tanks 140 are coincide with the vertical direction. Both ends of the tubes 110 and side plates 130 are connected to side portions of the tanks 140, so that the inside spaces of the tanks 140 are communicated with each other through the multiple tubes 110.

An inlet pipe 144 is provided at a middle portion of the tank 140 (the left-hand side tank 140 in FIG. 1), through which the engine cooling water flows into the tank 140. A drain cock 146 is also provided in the inside of the tank 140, to drain the engine cooling water to the outside of the tank 140. An outlet pipe 145 is further provided at a lower portion of the other tank 140 (the right-hand side tank in FIG. 1) to discharge the engine cooling water.

Female screw nut portions 141 are provided at the respective caps 143. And each of the screw nut portions 141 has a cylindrical portion 141*a*, a screwed portion 141*b* formed at an inner surface of the cylindrical portion 141*a*, and a flange portion 141*c*, as shown in FIG. 2. The female screw nut 141 has an open end at the flange portion 141*c* and a closed end opposite to the flange portion 141*c*.

A recess portion 143*b* is formed on an outer side of the cap member 143, as shown in FIGS. 2 and 3, and the female screw nut 141 is inserted into a hole 143*c* formed in the cap member 143, so that an outer end surface of the flange portion 141*c* may not protrude from an outer end surface 143*a* of the cap member 143. In this embodiment, a thickness of the flange portion 141*c* is made to be equal to a depth of the recess portion 143*b*, so that the outer end surfaces of the flange portion 141*c* and the cap 143 are located on the same plane.

The radiator 100 is mounted in an engine compartment by means of mounting brackets, for example, by the mounting brackets 10 shown in FIG. 3. The mounting bracket 10 comprises a disc-shape main body 11, a mounting pin 12 provided at a center of the main body 10 on its one side, and a screw 13 also provided at the center of the main body 11 on the opposite side. The mounting bracket 10 is fixed to the radiator tank 140 by screwing the screw 13 into the screwed portion 141*b* of the female screw nut 141.

When the radiator 100 is mounted in the engine compartment, the respective mounting pins 12 are fixed to an upper and a lower members of the engine compartment via rubber mounting elements (not shown). Accordingly, the radiator 100 is mounted in the engine compartment, being supported by the mounting pins at four points, namely respectively two points at an upper and lower vertical ends of the respective tanks 140.

In the radiator 100, the engine cooling water flows through the inlet pipe 144 into the (left) tank 140, further flows to the other (right) tank 140 through the multiple tubes 110, and discharged from the outlet pipe 145, as in the well known manner. The engine cooling water is cooled down during its flow through the tubes 110 by radiating heat from the engine cooling water to the ambient air (cooling air).

A vibration in the vertical direction is mainly transmitted to the radiator 100 via the mounting brackets 10 during a vehicle running. According to the present invention, however, since the female screw nut portions 141 are provided at the upper and lower ends of the tanks 140, and the mounting brackets 10 are connected to the screw nut portions 141, the mounting brackets 10 can be easily fixed to the radiator 100 and the tanks 140 having higher rigidity than the other portions receive the vibration. As a result, a higher vibration proof can be attained.

Further, according to the above embodiment, the recess portion 143*a* is formed on the outer side of the cap member 143 and the outer side surface of the screw nut portion 141 does not protrude from the outer surface 143*a*of the cap member 143. As a result, a compact size of the mounting portion can be obtained.

Figure 4:
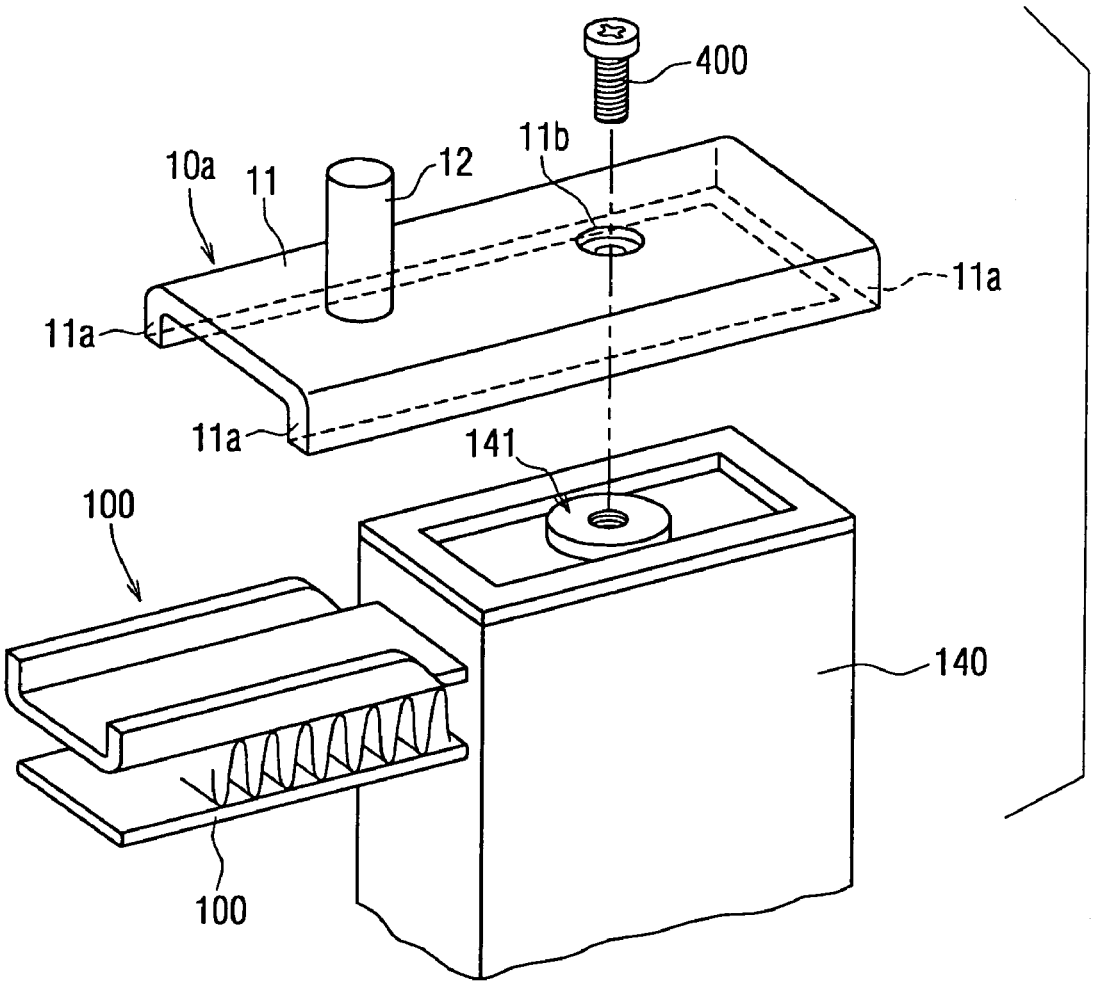
FIG. 4 is an exploded perspective view showing a modified bracket according to the first embodiment.

The structure of the mounting bracket 10 shall not be limited to the mounting bracket 10 shown in FIG. 3. A modification of the mounting bracket 10*a* is shown in FIG. 4. The bracket 10*a* comprises a main body 11 extending in a direction of the tubes 110, three bent portions 11*a* formed at three outer peripheries of the main body 11, to increase its rigidity, a counter boring 11*b* and the mounting pin 12 provided at a certain distance from the counter boring 11*b*. The bracket 10*a* is fixed to the tank 140 by screwing a bolt 400 into the counter boring 11*b* and the female screw nut portion 141.

In this modification, since the screw nut portion 141 and the mounting pin 12 are connected via the mounting bracket 10*a* with a high rigidity, a higher vibration proof of the radiator 100 can be attained. And in addition, a flexibility of designing a position of the mounting pin to the screw nut portion 141 can be likewise increased.

Although the invention is applied to the radiator 100 in the above embodiment, the present invention can be applied to other heat exchangers, such as a condenser 300 (as explained below in the second embodiment).

Second Embodiment

Figure 5:
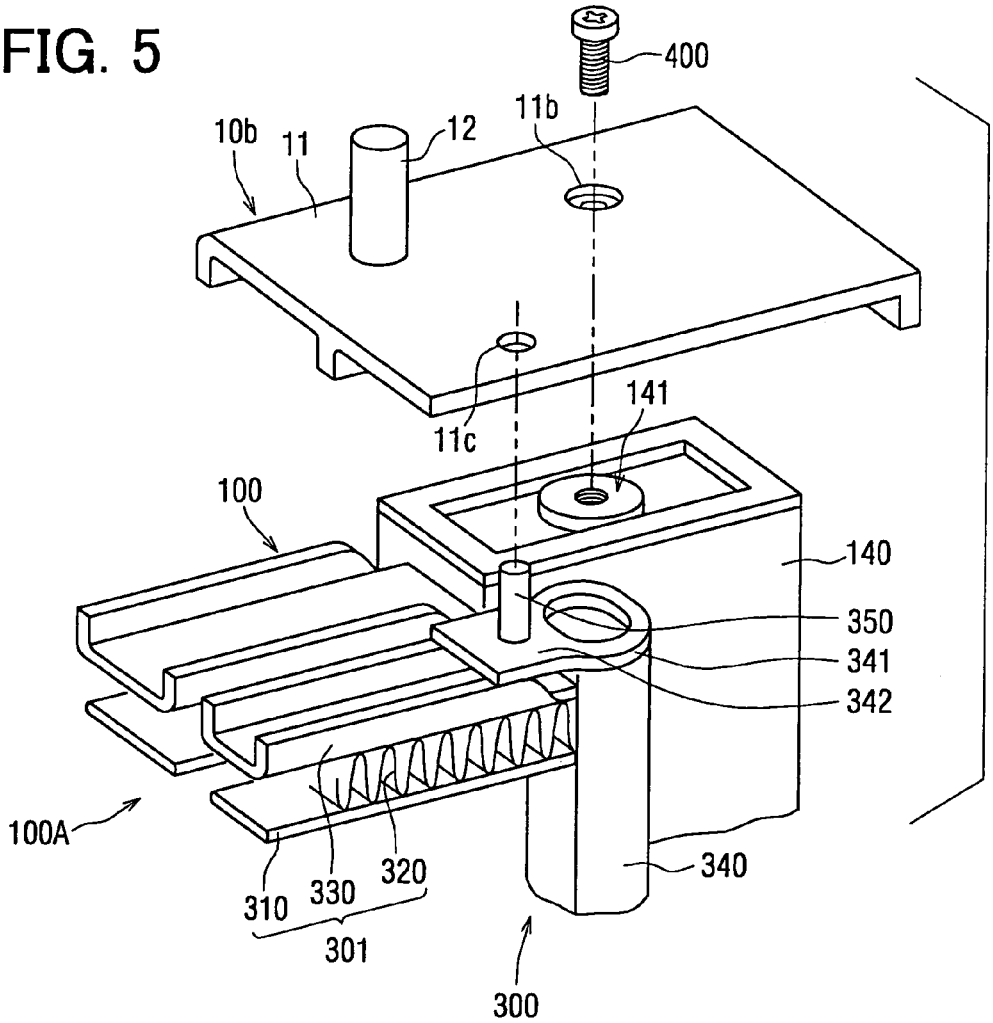
FIG. 5 is an exploded perspective view showing a bracket according to a second embodiment.

FIG. 5 shows a dual type heat exchanger 100A, in which a condenser 300 is integrally assembled to the radiator 100 of the above explained first embodiment.

The condenser 300 is an aluminum heat exchanger for condensing a refrigerant for a vehicle refrigerating cycle. The basic structure of the condenser 300 is the same to that of the radiator 100, namely the condenser 300 is of the cross flow type comprising a core portion 301 having multiple tubes 310 and multiple fins 320 and a pair of side plates 330, and a pair of header tanks 340 of a cylindrical form.

A pair of cap members 341 are provided at both (upper and lower) ends of the header tanks 340, for closing the both ends. Each of the cap members 341 is formed with an extending portion 342, one side of which is brazed to the side plate 330 and a mounting pin 350 is formed on the other side of the extending portion. The cap members 341 are provided at the upper and lower ends of the header tanks 340 (four points).

A vertical dimension (height) of the condenser 300 is designed to be equal to or substantially similar to that of the radiator 100. The condenser 300 and the radiator 100 are arranged in a line of the flow of the cooling air, and they are integrally assembled by multiple mounting brackets 10*b*.

Each of the mounting brackets 10*b* has a similar structure to the mounting bracket 10*a* shown in FIG. 4. The main body 11 of the mounting bracket 10*b* has another extending portion extending in a direction to the condenser 300. And a pin hole 11*c* is formed in the extending portion of the main body 11.

When the mounting brackets 10*b* are fixed to the radiator 100 (to the screw nut portions 141), the mounting pins 350 of the condenser 300 are at first inserted into the respective pin holes 11*c* of the mounting brackets 10*b* and then the brackets 10*b* are firmly fixed to the radiator 100 by bolts 400, which are screwed into the female screw nut portions 141. Accordingly, the dual type heat exchanger 100A, in which the condenser 300 is integrally assembled to the radiator 100 is realized, in which a higher vibration proof of the radiator 100 can be attained.

The mounting pin 350 can be provided at a different position other than the extending portion of the cap member 341. For example, as in the same manner of the first embodiment shown in FIG. 3, the mounting pin 350 can be provided at a center of the cap member 341. According to such a modification, the rigidity (the vibration proof) of the condenser 300 can be further improved.

Third Embodiment

Figure 6A:
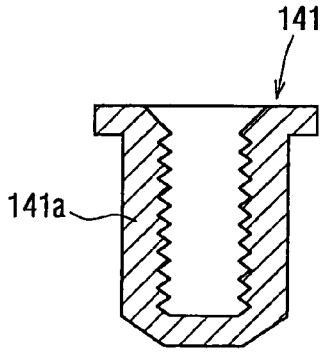
FIG. 6A is a cross-sectional view of a screw nut according to the first embodiment.
Figure 6B:
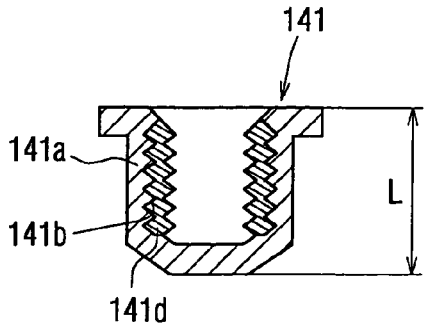
FIG. 6B is a cross-sectional view of a screw nut according to third embodiment.

A third embodiment of the present invention will be explained with reference to FIGS. 6A and 6B, wherein FIG. 6A shows a cross sectional view of the screw nut portion 141 of the first embodiment, while FIG. 6B shows a cross sectional view of a modified screw nut portion. The modification aims at a size down of the screw nut portion.

The screw nut portion 141 of FIG. 6B comprises two different metal materials. As in the first embodiment, the screwed portion 141*b* is formed at the inner surface of the cylindrical portion 141*a*. In addition, a screw element 141*d* having screwed portions on both outer and inner surfaces is screwed into the cylindrical portion 141*a*, wherein a metal material for the screw element 141*d* is selected so that a breaking force for the screw element 141*d* is higher than a breaking force for the cylindrical portion 141*a*. For example, the cylindrical portion 141*a* is made of aluminum or aluminum alloy, while the screw element 141*d* is made of iron or steel.

According to the above embodiment, a number of screw heads to be screwed together with the bolt 400 can be reduced because of the higher mechanical strength of the screw element 141*d*, and thereby a length L of the screw nut portion 141 can be shortened compared with the screw nut portion 141 of FIG. 6A. As a consequence, a portion of the cylindrical portion 141*a* extending into the inside space of the tank 140 or the header tank 340 can be made smaller, reducing an unfavorable influence on a flow of the engine cooling water in the tank 140 or 340.

Fourth Embodiment

Figure 7:
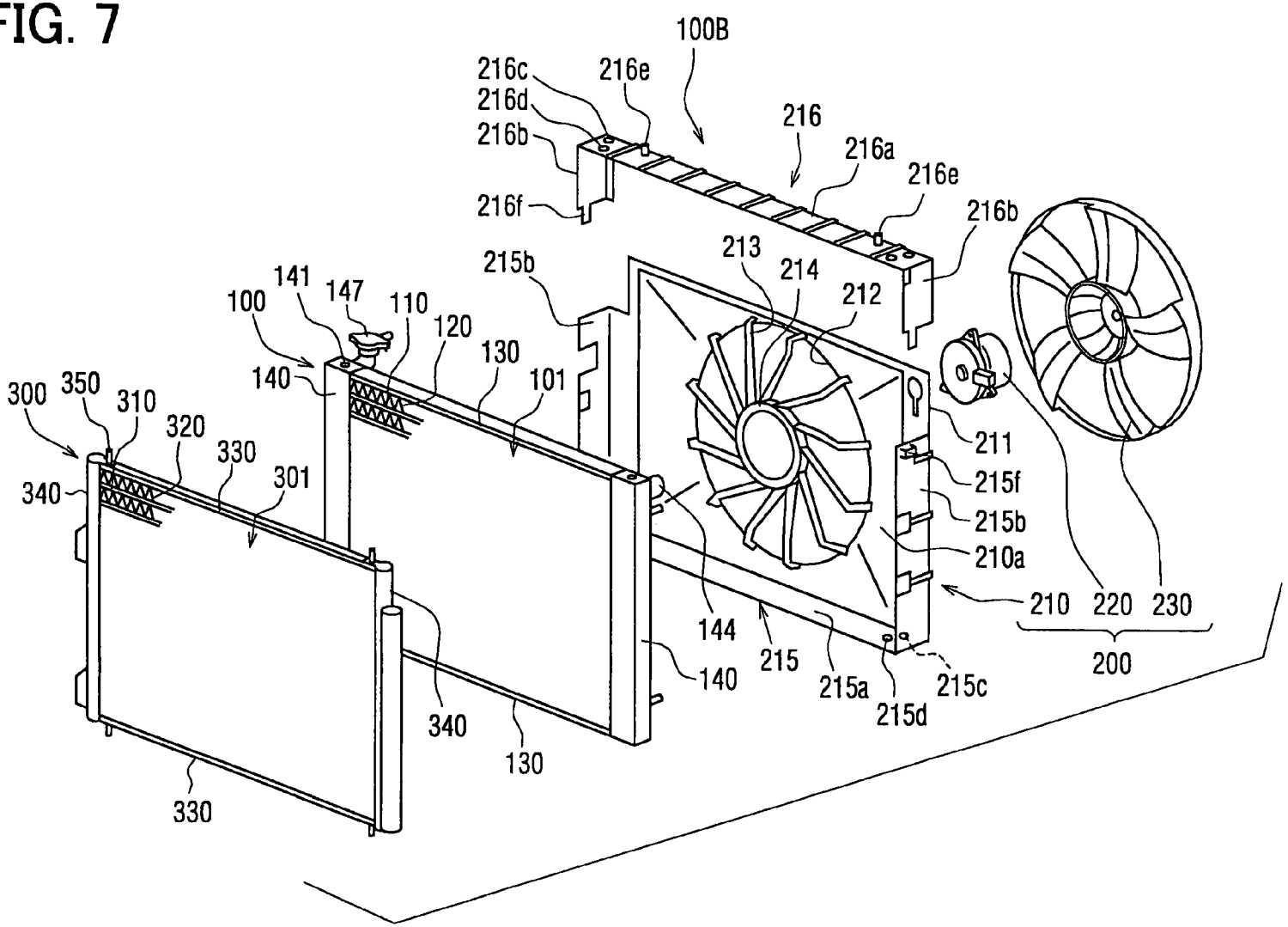
FIG. 7 is an exploded perspective view showing a cooling module according to a fourth embodiment.
Figure 8:
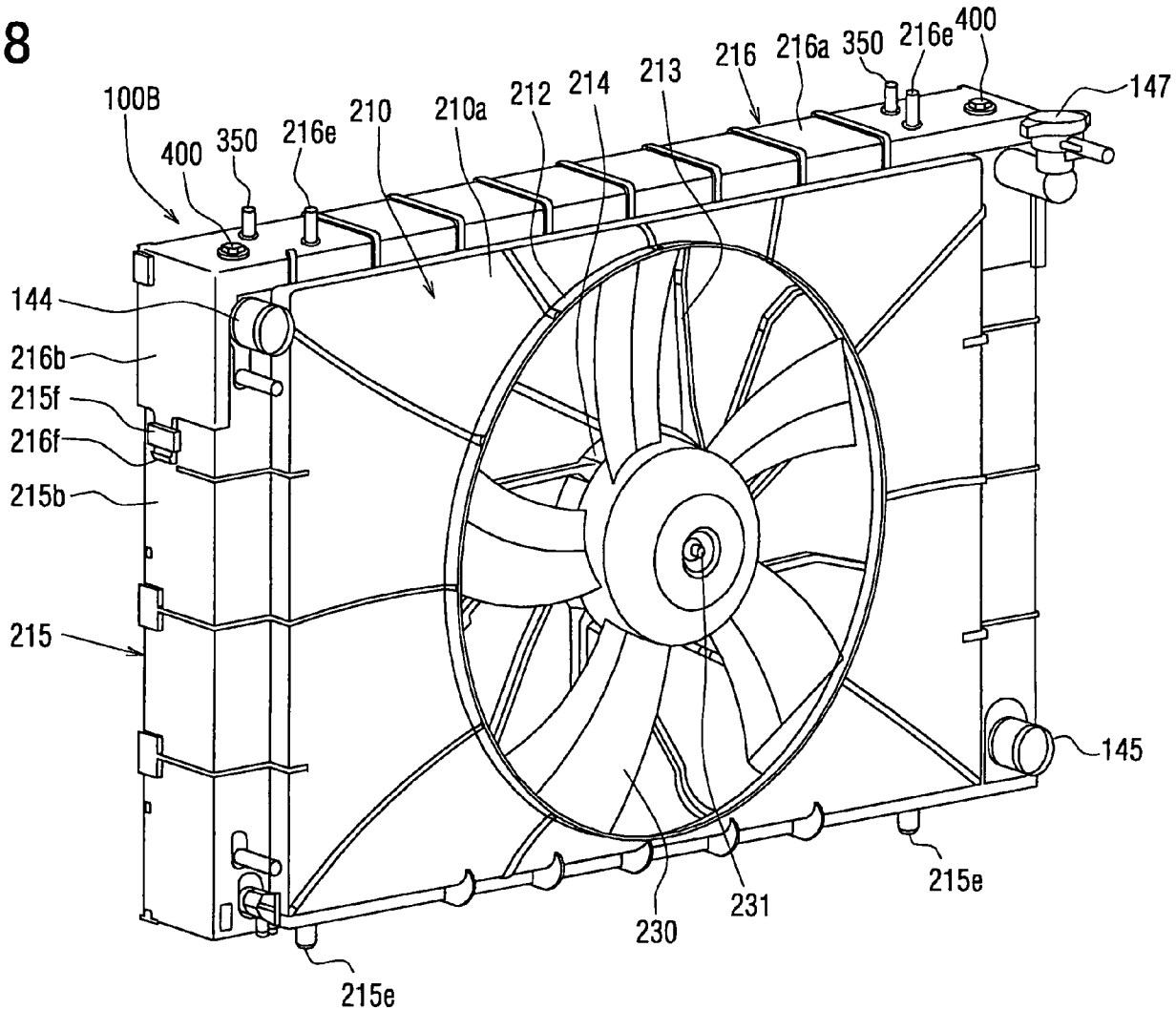
FIG. 8 is a perspective view of the cooling module, in which parts shown in FIG. 7 are integrally assembled.

FIGS. 7 and 8 show a cooling module 100B, in which a condenser 300 as well as a radiator fan device 200 are integrally assembled to the radiator 100. FIG. 7 shows an exploded perspective view of the cooling module 100B, while FIG. 8 shows a perspective view of the same in an assembled condition.

The cooling module 100B comprises multiple heat exchangers (in this embodiment, the radiator 100 and the condenser 300) and the radiator fan device 200, which are integrally assembled to one unit and the cooling module 100B is mounted into the engine compartment as such one unit (as one unit shown in FIG. 8). The radiator 100 in this embodiment differs from the radiator 100 of the first embodiment in that a water pouring port 147, which is provided on the tank 140 to which the outlet port 145 (not shown in FIG. 7) is provided, is indicated in the drawings of FIGS. 7 and 8. The condenser 300 is the same to that shown in FIG. 5.

The radiator fan device 200 comprises a shroud 210, an electric motor 220 and a fan 230, which are integrally assembled to one unit. The radiator fan device 200 is an air blowing device for sending air to the radiator 100 and the condenser 300. In this embodiment, however, the radiator fan device 200 is of a draw-in type, in which air is drawn by the fan 230 so that the cooling air flows from an upstream side of the condenser 300 through the condenser 300 and the radiator 100 to the fan 230.

The shroud 210 is made of a resin, such as polypropylene, by an injection molding process. The shroud 210 comprises an outer periphery portion 211 having a rectangular form in conformity with an outer shape of the radiator 100, an air guiding plate portion 210*a* extending from the outer peripheral portion 211 toward a center of the shroud and being backwardly inclined (in a direction opposite to the radiator 100), and a ring portion 212. A motor mounting portion 214, which is supported by multiple motor stay arms 213, is formed in the shroud 210. The electric motor 220 is fixed to the motor mounting portion 214 by multiple bolts (not shown) and the fan 230 is fixed to a motor shaft of the motor 220 by a nut 231 (shown in FIG. 8).

A lower frame 215, extending toward the radiator 100 (in a direction opposite to the electric motor 220), is integrally formed with the outer periphery portion 211. An upper frame 216 is detachably provided to the lower frame 215.

The lower frame 215 comprises a bottom mounting portion 215*a* and a pair of side wall portions 215*b*, which form as a whole a U-shape opening upwardly. Multiple pin holes 215*c* and 215*d* are formed at the bottom mounting portion 215*a*, which respectively correspond to positions of the female screw nut portions 141 of the radiator 100 and the mounting pins 350 of the condenser 300. Multiple mounting pins 215*e* are provided at the lower frame 215 on a lower side and close to the pin holes 215*c*. A pair of connecting portions 215*f* are formed at the respective side wall portions 215*b*, into which a pair of projections 216*f* of the upper frame 216 will be inserted.

The upper frame 216 likewise comprises a top mounting portion 216*a* and a pair of side wall portions 216*b*, which form as a whole a U-shape opening downwardly. A vertical length of the side wall portions 216*b* of the upper frame 216 is made shorter than that of the lower frame 215. The pair of projections 216*f* are formed at lower ends of the side wall portions 216*b*, which will be inserted into the connecting portions 215*f* of the lower frame 215, as mentioned above. Multiple pin holes 216*c* and 216*d* are likewise formed at the top mounting portion 216*a*, which respectively correspond to positions of the female screw nut portions 141 of the radiator 100 and the mounting pins 350 of the condenser 300. When the upper frame 216 is assembled to the radiator 100 by multiple bolts 400, the projections 216*f* are inserted into the connecting portions 215*f*, as shown in FIG. 8.

The radiator 100 and the condenser 300 are arranged onto the lower frame 215, wherein the lower frame 215 of the shroud 210 is fixed to the radiator 100 by the bolts (400) screwed into the female screw nut portions (141) through the pin holes 215*c*, and the condenser 300 is positioned in place by inserting the mounting pins 350 into the pin holes 215*d*.

The upper frame 216 is then assembled to the lower frame 215, wherein the upper frame 216 is fixed to the radiator 100 by the bolts 400 screwed into the female screw nut portions 141 of the radiator 100 through the pin holes 216*c*, and the condenser 300 is positioned in place by inserting the mounting pins 350 into the pin holes 216*d*. As a result, the radiator 100 and the condenser 300 are tightly held by the shroud 210 (the lower and upper frames 215 and 216).

As above, the shroud 210 is integrally assembled to the radiator 100 and the condenser 300 to form the cooling module 100B, and then the cooling module 100B is mounted into the engine compartment by the mounting pins 215*e* and 216*e*, respectively provided on the lower and upper frames 215 and 216 (the bottom mounting portion 215*a* and the top mounting portion 216*a*).

As in the same manner to the first embodiment, the tanks 140 of the radiator 100, which has a higher rigidity, receives the vertical vibration from the vehicle. As a result, a higher vibration proof can be attained.

Furthermore, since the shroud 210 is tightly held by the tanks 140 of the radiator 100, portions of the bottom mounting portion 215*a* and the top mounting portion 216*a* between the mounting pins 215*e* and 216*e* may not require a higher rigidity. Accordingly, the shroud 210 can be formed of thin walls or plates, achieving a light weight and a cost down of the shroud 210.

In the above embodiment, since the shroud 210 is composed of two parts (lower and upper frames 215 and 216) divided in the vertical direction, the shroud 210 can tolerate dimensional variations for the heights of the radiator 100 and the condenser 300, to improve an assembling efficiency. Furthermore, since spaces between the shroud 210 (the bottom mounting portion 215*a*, the top mounting portion 216*a*, and the side wall portions 215*b* and 216*b*) and the outer peripheries of the radiator 100 and the condenser 300 can be made smaller, a bypassing flow of the cooling air through such spaces (bypassing the core portions of tubes 110 and fins 120) can be suppressed.

In the above embodiment, although the radiator fan device 200 is integrally assembled to the radiator 100 and the condenser 300, other variations can be likewise possible. For example, the radiator fan device 200 can be assembled to the radiator 100 alone, or the radiator fan device 200 can be assembled to the radiator 100, the condenser 300 and other heat exchangers, such as an intercooler, a sub-radiator.

Fifth Embodiment

In the above explained first to fourth embodiments, the screw nut portions 141 are provided in the tanks 140 of the radiator 100 at the respective vertical ends of the tanks 140. The screw nut portions 141, however, can be provided at side surfaces of the tanks 140.

Figure 9A:
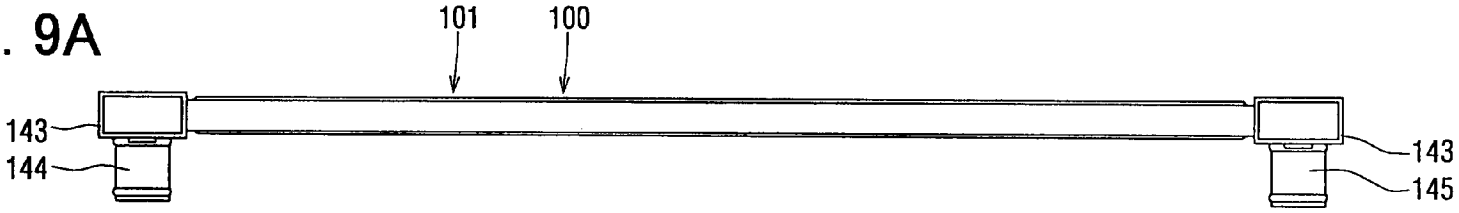
FIGS. 9A and 9B are a top plan view and a front view showing the radiator according to a fifth embodiment, in which the screw nuts are provided at different positions than those of the first embodiment.
Figure 9B:
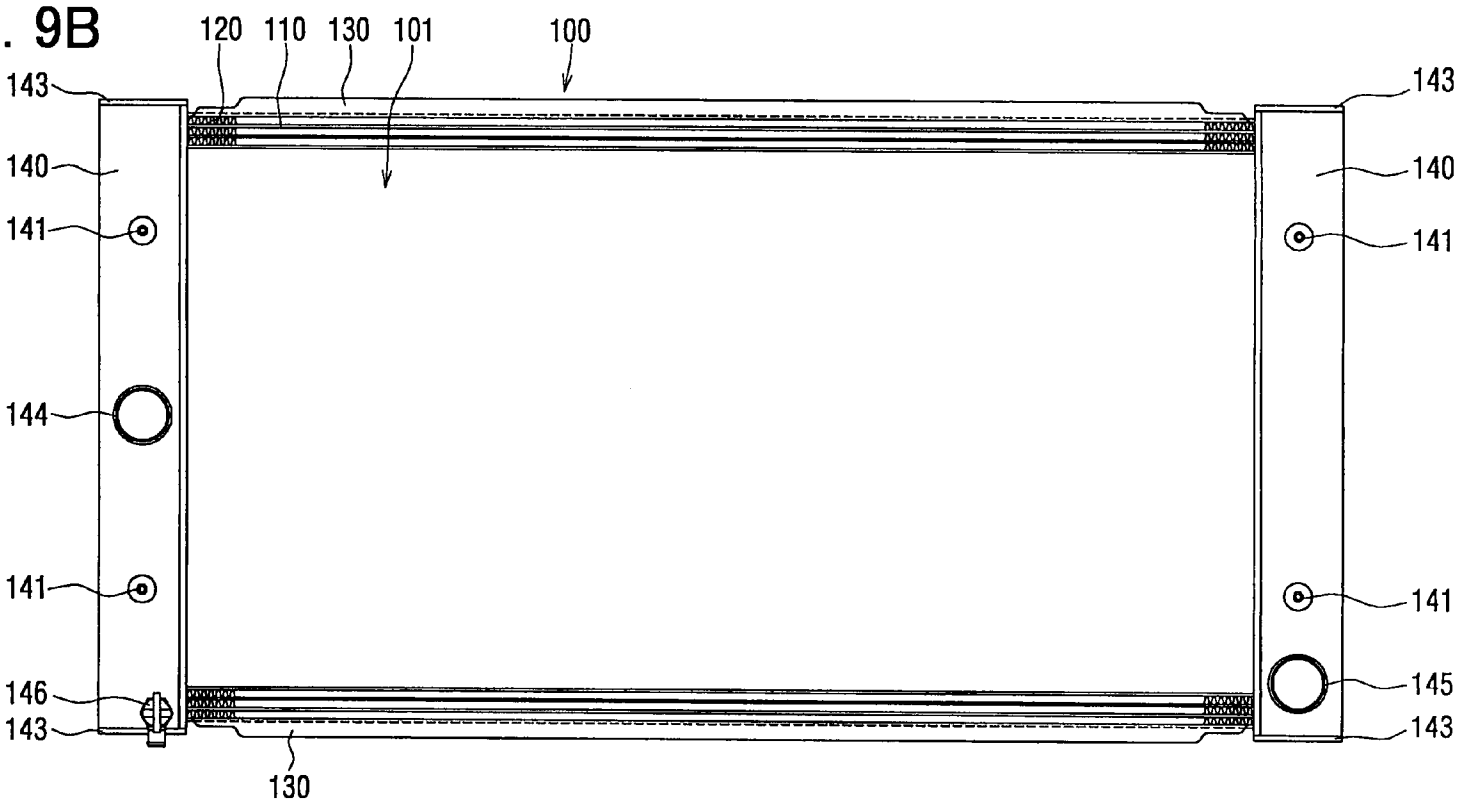
Figure 10B:
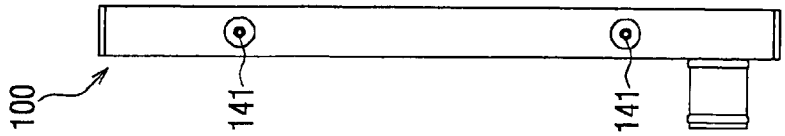
FIGS. 10A and 10B are likewise a top plan view and a front view of the radiator according to a modification of the fifth embodiment.
Figure 10A:
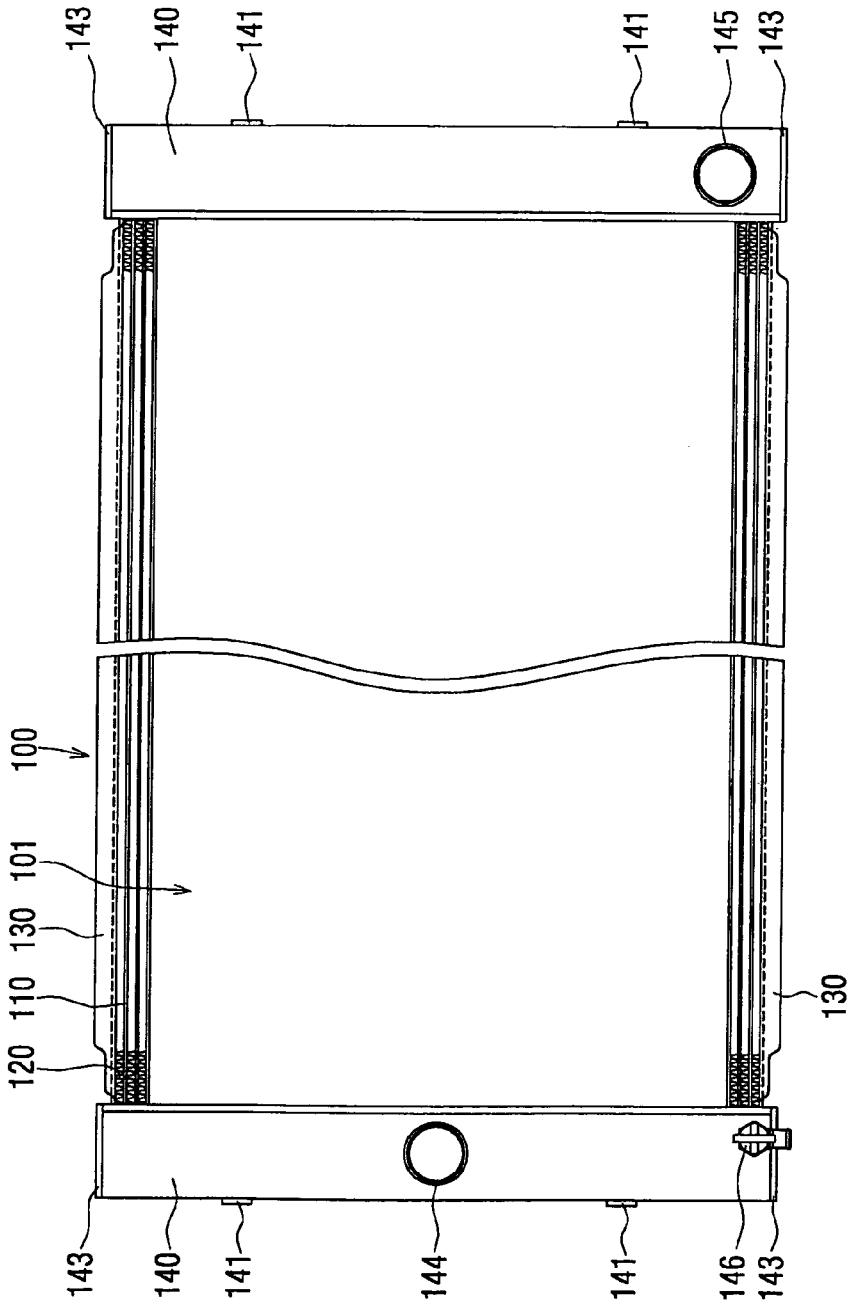
Figure 11A:
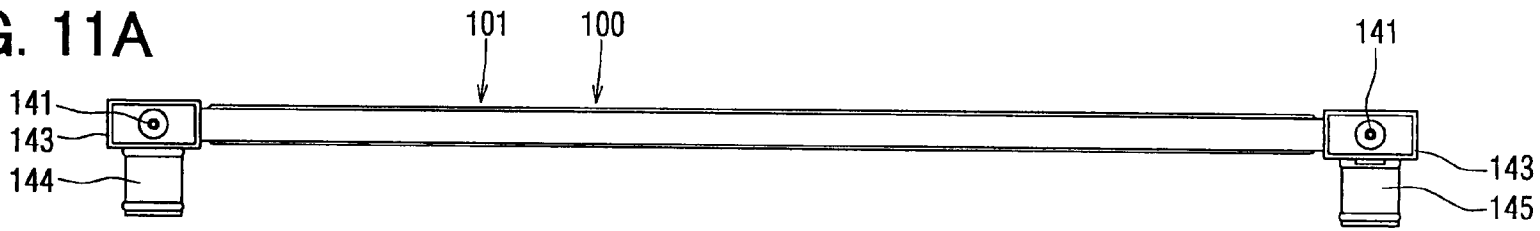
FIGS. 11A and 11B are likewise a top plan view and a front view of the radiator according to another modification of the fifth embodiment.
Figure 11B:
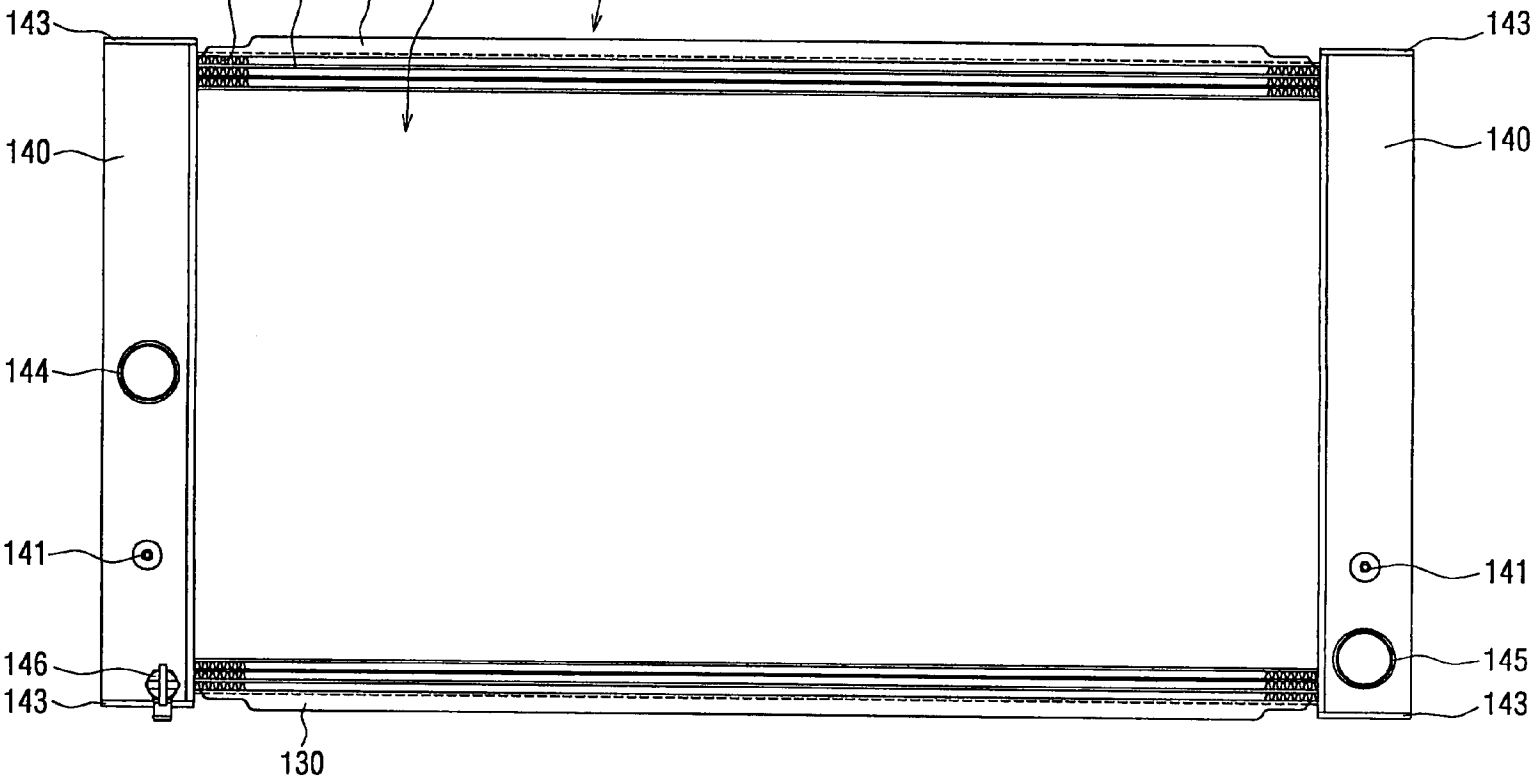
Figure 12A:
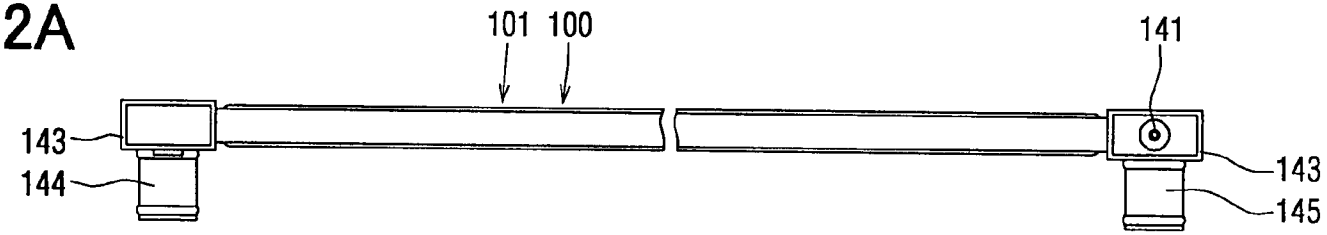
FIGS. 12A and 12B are likewise a top plan view and a front view of the radiator according to a further modification of the fifth embodiment.
Figure 12B:
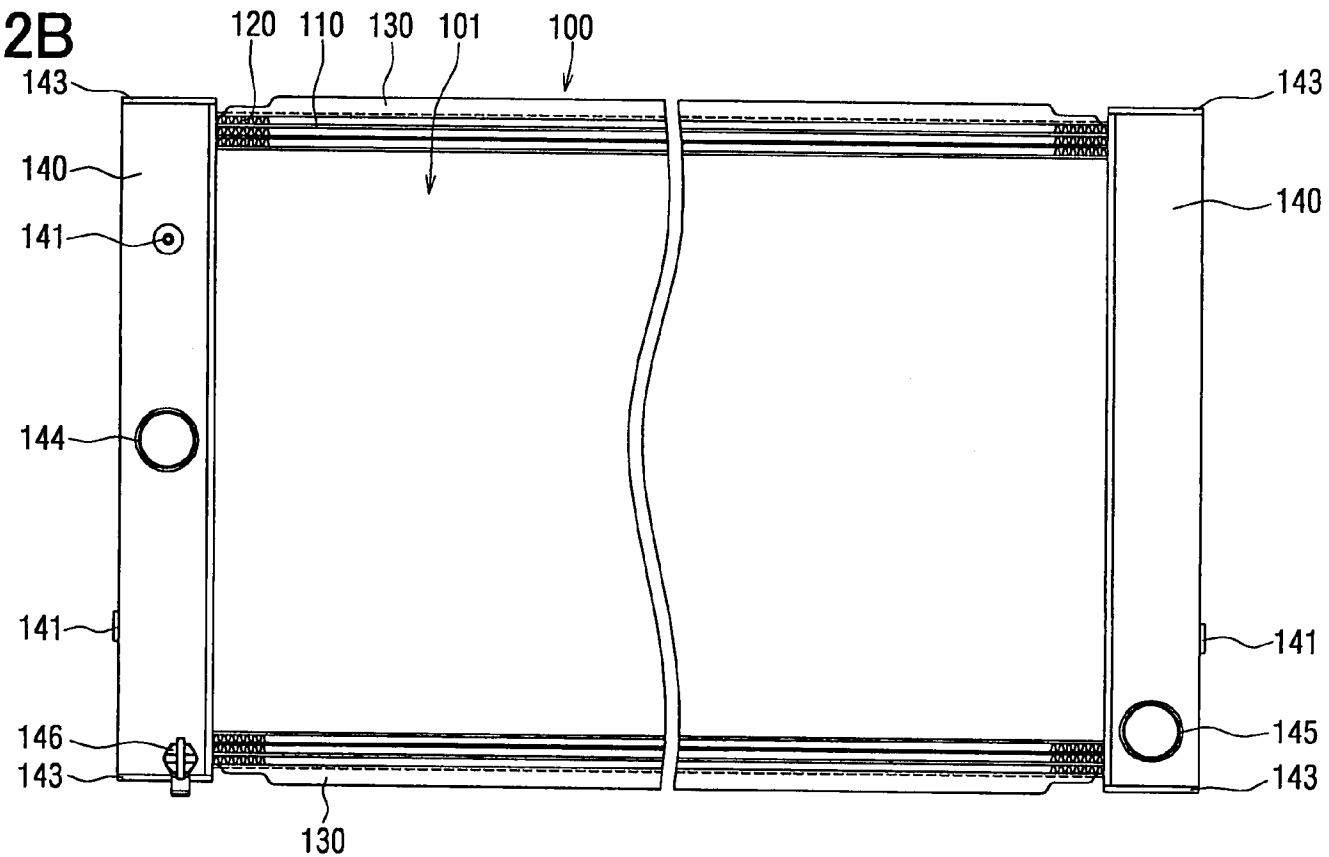

The screw nut portions 141 can be provided at the side surfaces of the tanks 140, as shown in FIGS. 9A and 9B, wherein the screw nut portions are provided at the same side surfaces at which the inlet and outlet pipes 144 and 145 are provided. Furthermore, the screw nut portions 141 can be provided at the side surfaces of the tanks 140, as shown in FIGS. 10A and 10B, wherein the side surfaces for the screw nut portions 141 are horizontally opposing to each other.

Furthermore, as shown in FIGS. 11A & 11B or 12A & 12B, one or some of the screw nut portions 141 are provided at the vertical ends of the tanks 140, while the remaining screw nut portions 141 are provided at the side surfaces of the tanks 140.

Sixth Embodiment

Figure 13A:
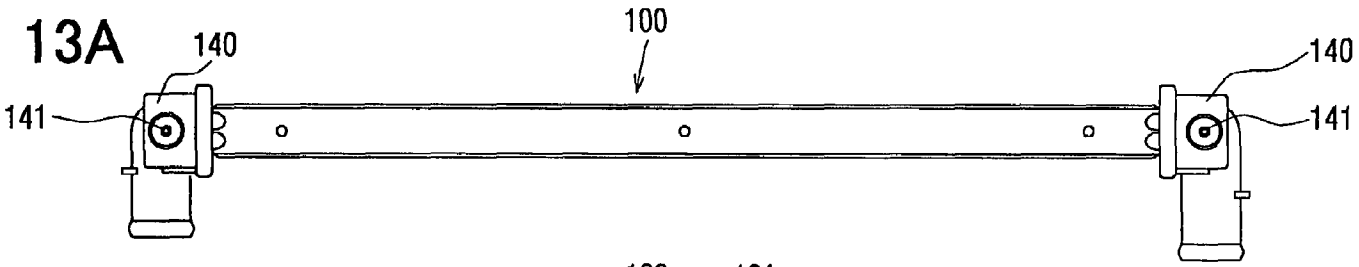
FIGS. 13A and 13B are a top plan view and a front view of the radiator according to a sixth embodiment.
Figure 13B:
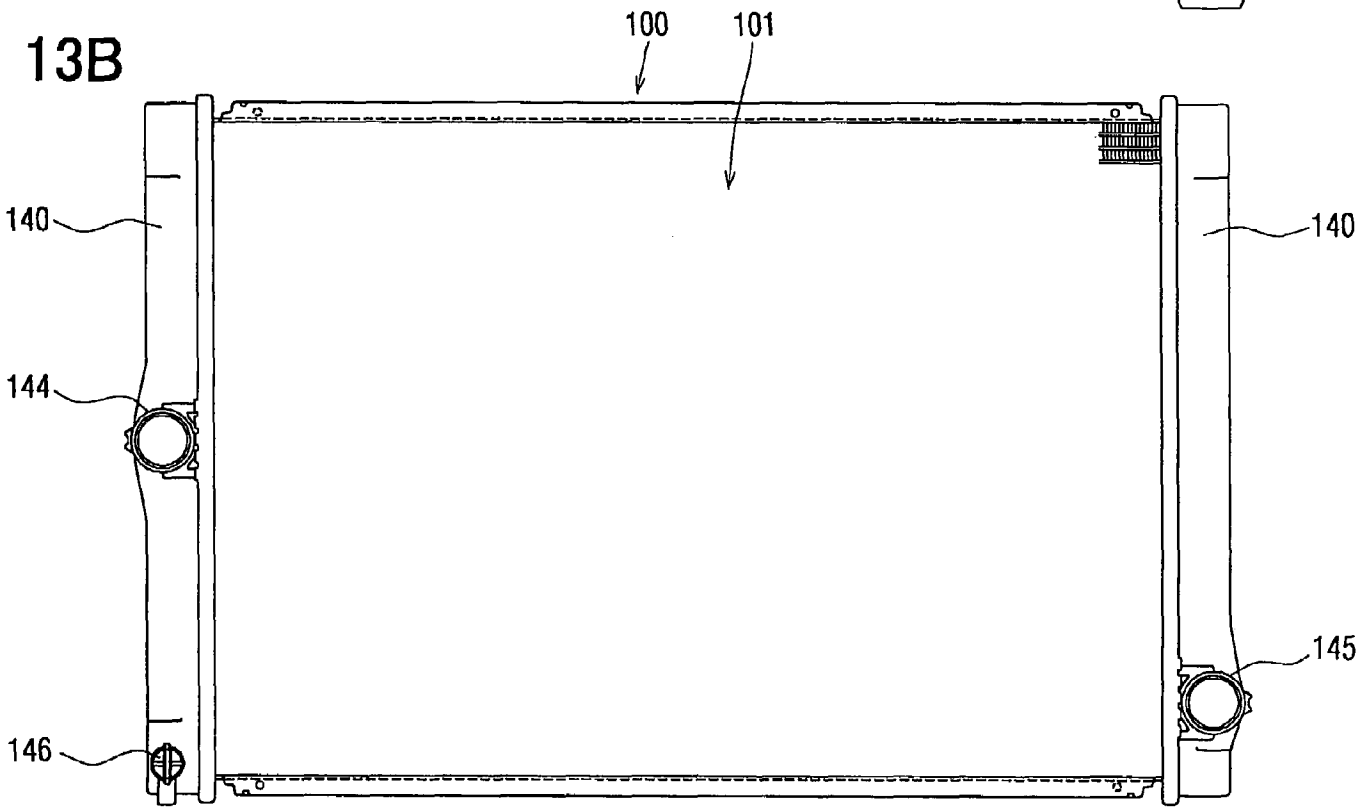
Figure 14:
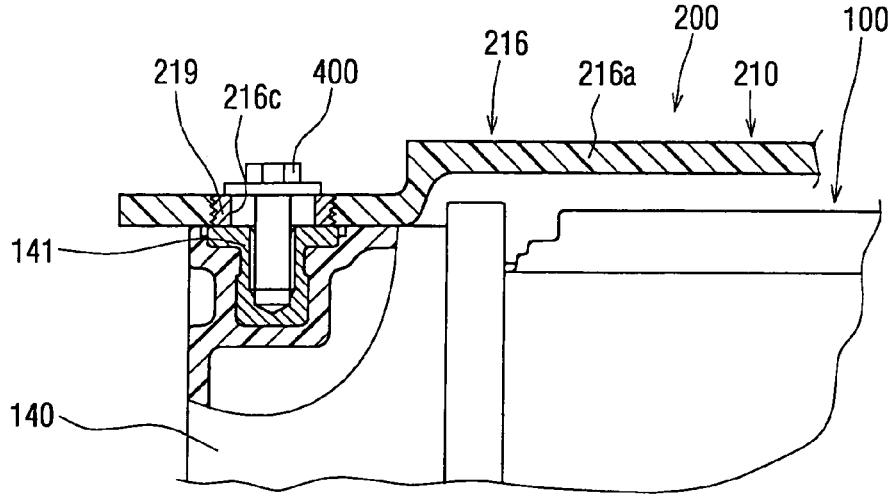
FIG. 14 is a cross-sectional view showing a screw nut fixed to a tank of the radiator.
Figure 15:
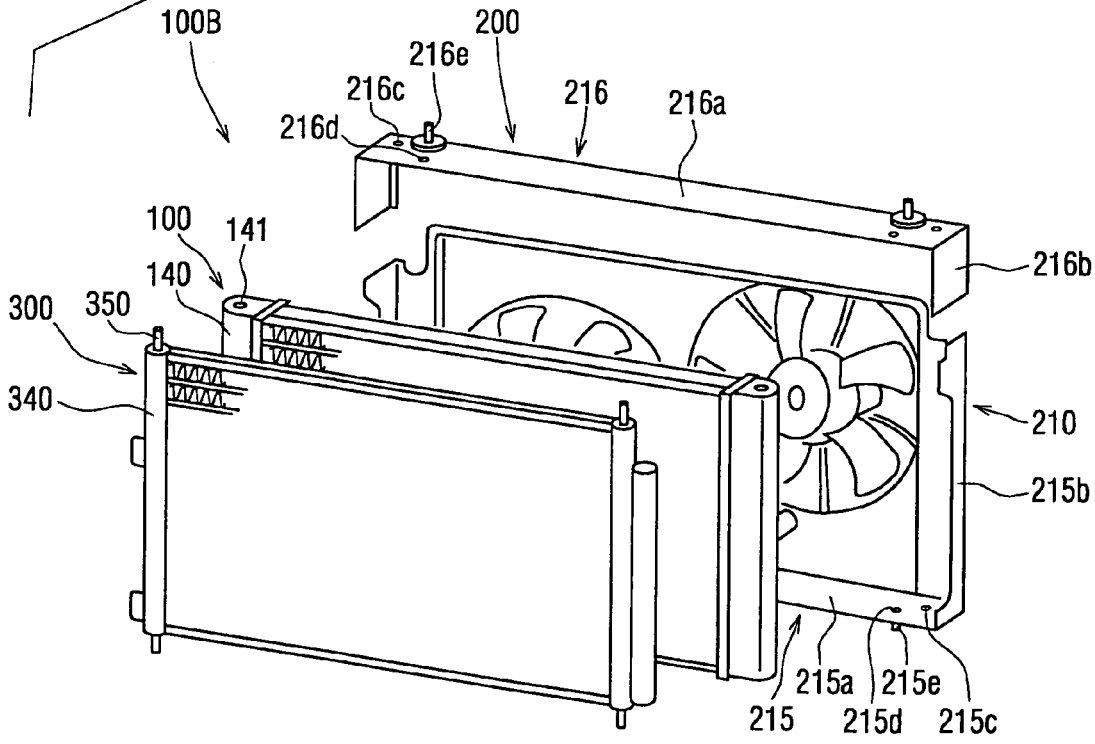
FIG. 15 is a perspective view showing a cooling module according to the sixth embodiment.

A sixth embodiment of the present invention is shown in FIGS. 13 to 15, in which the tanks 140 of the radiator 100 are made of a resin.

The tanks 140 are made of nylon material including a predetermined amount of glass fiber. The inlet pipe 144, the outlet pipe 145 and drain cock 146 are integrally formed by the injection molding process, and the screw nut portions 141 are integrally formed by an insert molding process.

As shown in FIG. 14, multiple metal collars 219 are integrally fixed, by the insert molding process, to the top mounting portion 216*a* of the upper frame 216 of the shroud 210.

Although not shown in the drawing, multiple metal collars are likewise fixed to the bottom mounting portion 215*a* of the lower frame 215. Each of the metal collars 219 has a bore 216*c* (215*c* at the bottom mounting portion 215*a*), through which the bolts 400 are inserted and screwed to the screw nut portions 141. The mounting pins 350 are provided at both vertical ends of the header tanks 340, as in the above other embodiments.

As in the same manner to the fourth embodiment shown in FIG. 7, the shroud 210 is fixed to the radiator 100 by the bolts 400 screwed into the screw nut portions 141, and the condenser 300 is tightly held by the shroud 210 by inserting the mounting pins 350 into the respective pin holes 215*d* and 216*d* of the lower and upper frames 215 and 216, so that the cooling module 100B is formed.

As above, the cooling module 100B of the sixth embodiment can achieve the same effect to the fourth embodiment, and in addition the screw nut portions 141 can be easily fixed to the tanks 140 because the tanks 140 are made of the resin material and the screw nut portions 141 are fixed to the tanks by the insert molding process.

Figure 16:
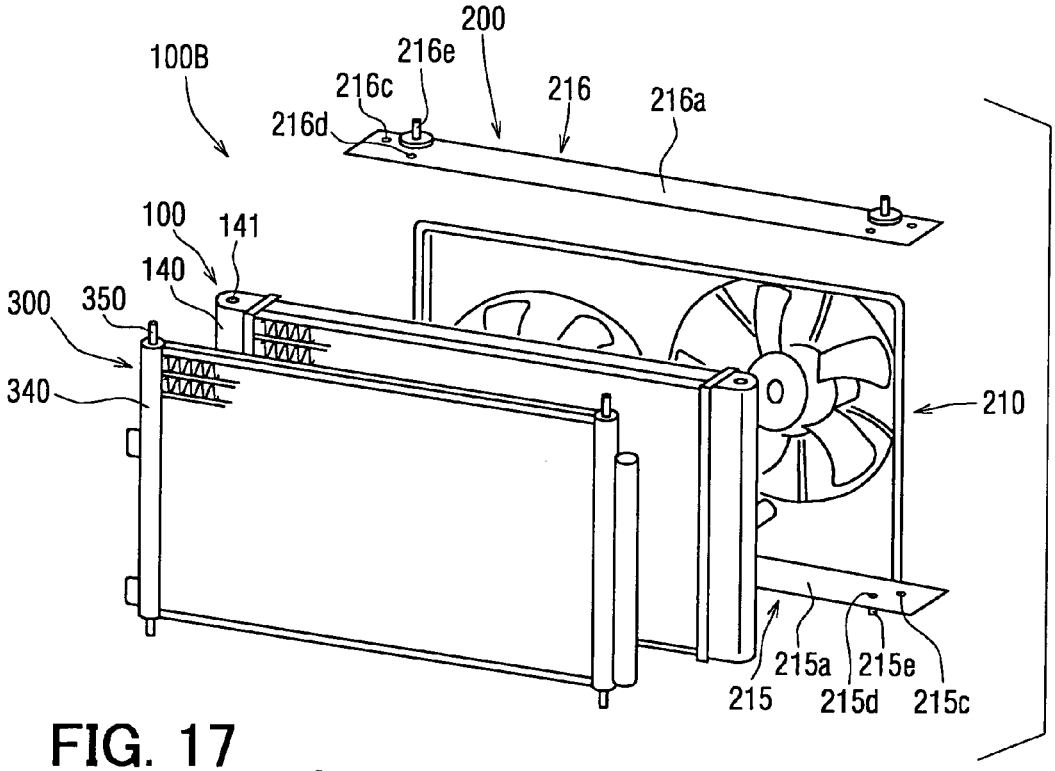
FIG. 16 is also a perspective view showing a cooling module according to a modification of the sixth embodiment.

The side wall portions 215*b* and 216*b* of the lower and upper frames 215 and 216 of the shroud 210 can be removed, as shown in FIG. 16.

Seventh Embodiment

Figure 17:
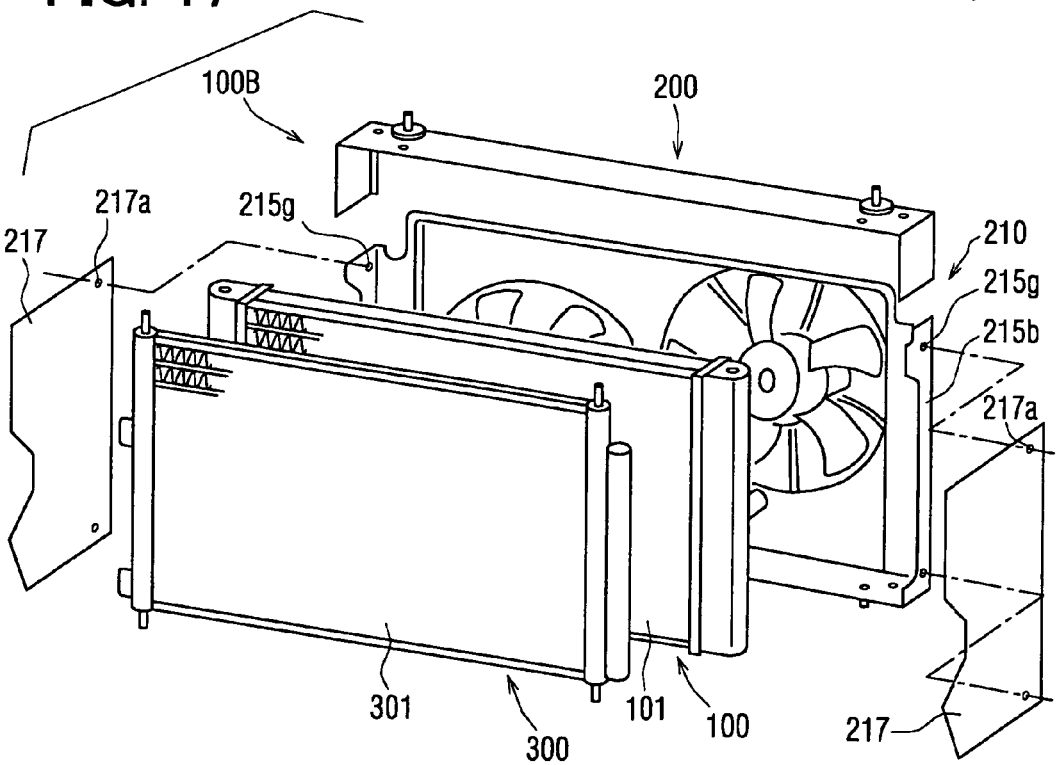
FIG. 17 is a perspective view showing a cooling module according to seventh embodiment.

A seventh embodiment of the present invention is shown in FIG. 17, in which air guide plates 217 are added to the sixth embodiment shown in FIGS. 13 to 16.

The air guide plates 217 are plate elements made of a resin material and have multiple holes 217*a*. Multiple holes 215*g* are also formed at the side wall portions 215*b* of the lower frame 215, wherein the air guide plates 217 are fixed to the shroud 210 by multiple clip pins (not shown) inserted into the holes 217*a* of the air guide plates 217 and the corresponding holes 215*g* of the shroud 210. The air guide plates 217 extend from the side wall portions 215*b* of the shroud 210 toward a front end of the vehicle, for example, a bumper opening or a front grille of the vehicle.

Accordingly, the air guide plates 217 effectively guide the cooling air coming from a front side of the vehicle toward the respective core portions 101 and 301 of the radiator 100 and the condenser 300, to improve their heat exchanging performances.

A configuration of a space between the cooling module (the radiator 100 and the condenser 300) and the front end of the vehicle varies depending on vehicle models. And therefore, when the air guide plates 217 are made as separate elements from the shroud 210, the same cooling module 100B can be used to different vehicle models, by simply changing the air guide plates 217. Furthermore, the air guide plates 217 can be so designed that the air guide plates 217 may be departed from the cooling module 100B, at the points of the clip pins, by an impact strength at a vehicle crash. As a result, a damage to the cooling module 100B can be avoided or reduced.

Figure 18:
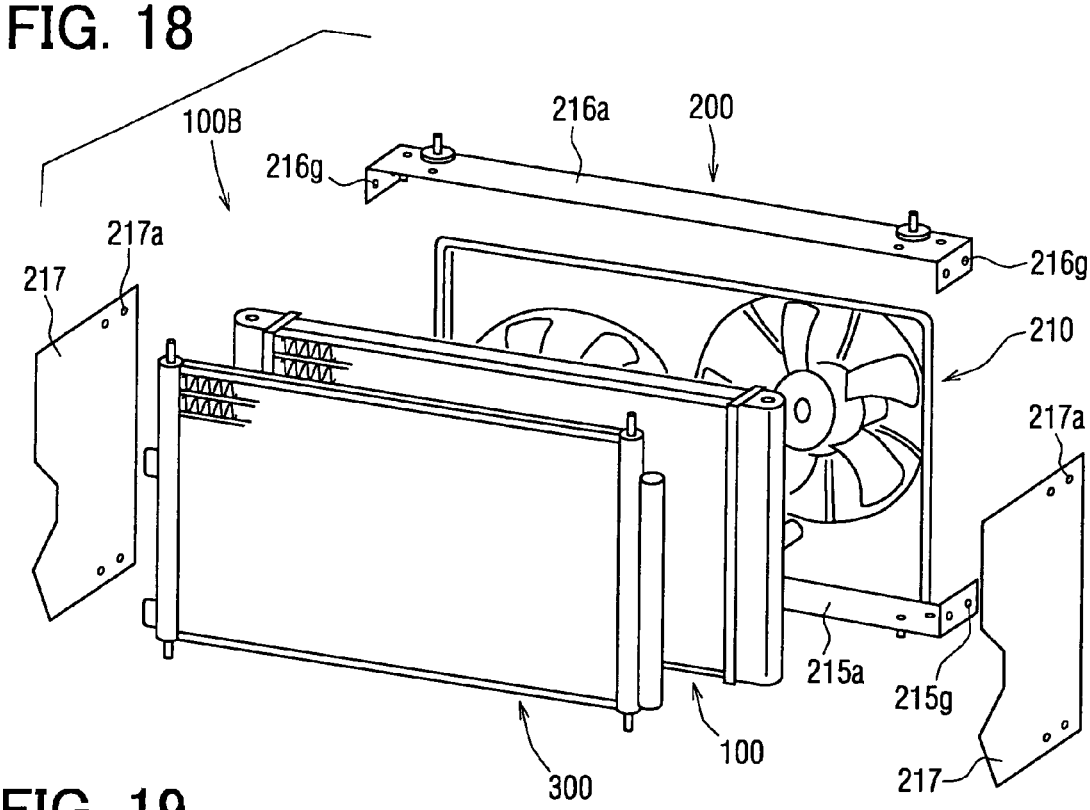
FIG. 18 is also a perspective view showing a cooling module according to a modification of the seventh embodiment.

A modification of the seventh embodiment is shown in FIG. 18, in which the side wall portions 215*b* are not formed at the shroud 210 (the lower frame 215 of the shroud 210). In this case, the holes 215*g* and 216*g* are formed at the bottom mounting portion 215*a* and the top mounting portion 216*a* for fixing the air guide plates 217.

Figure 19:
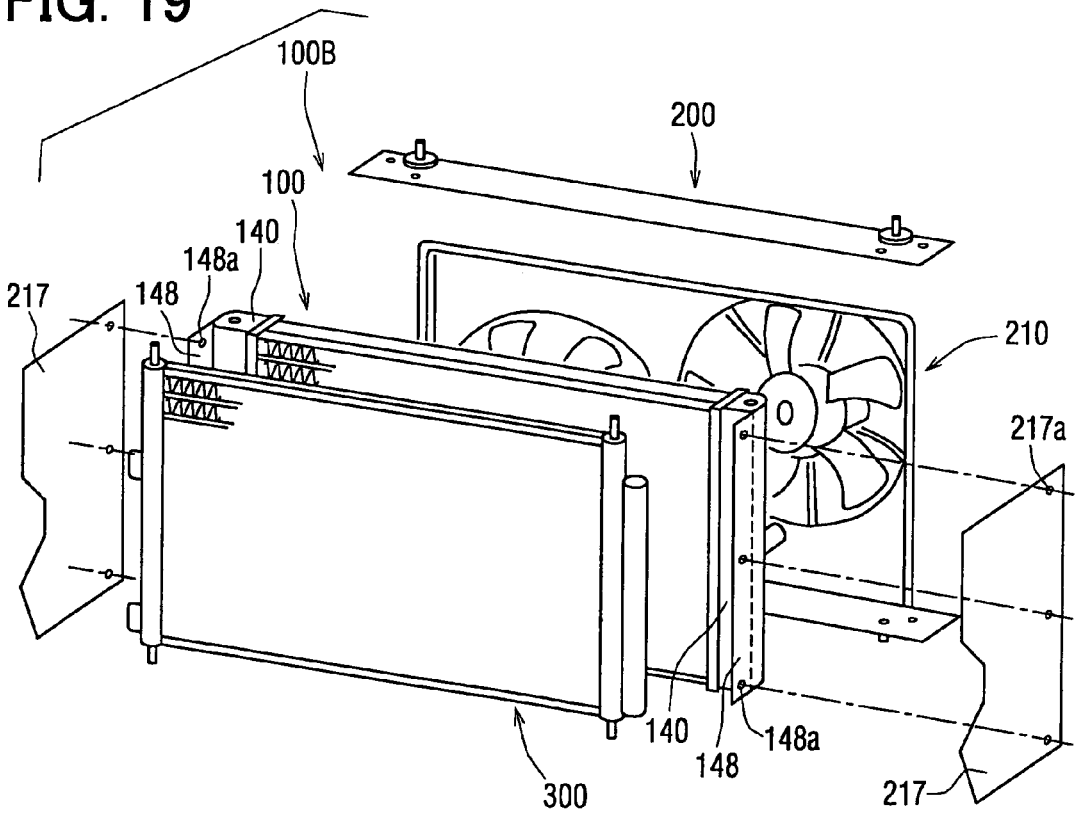
FIG. 19 is also a perspective view showing a cooling module according to another modification of the seventh embodiment.

Furthermore, as shown in FIG. 19, corresponding holes 148*a* can be formed at over-hanging portions 148 of the tanks 140, wherein the over-hanging portions 148 are integrally formed with the tanks 140.

The air guide plates 217 can be fixed to the shroud 210 or the tanks 140, not only by the clip pins but by any other fixing means.

In the above seventh embodiment shown in FIGS. 17 to 19, the air guide plates 217 are made as the different elements from the shroud 210. However, the air guide plates can be integrally formed with the shroud 210 or with the tanks 140 of the radiator 100. In such a modification, a low rigid portion (for example, a thin-walled portion) is purposefully formed at any relevant portion of the air guide plates, so that the air guide plates may be preferentially broken down at the vehicle crash, to thereby avoid and/or reduce a possible damage to the cooling module 100B. When the air guide plates are integrally formed with the shroud or the radiator, a number of assembling processes can be reduced to achieve a cost down.

Eighth Embodiment

Figure 20:
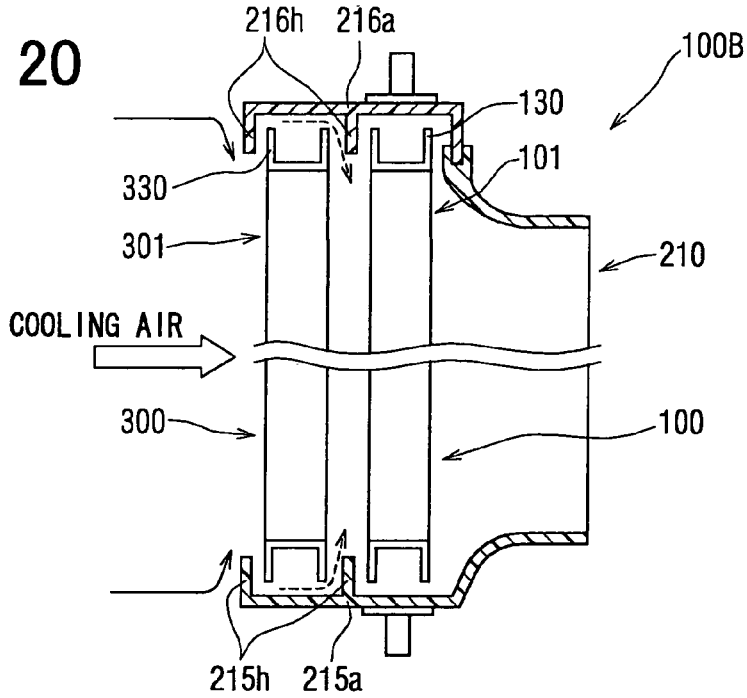
FIG. 20 is a cross-sectional view of the cooling module, when taken along a vertical plane, according to an eighth embodiment.
Figure 21:
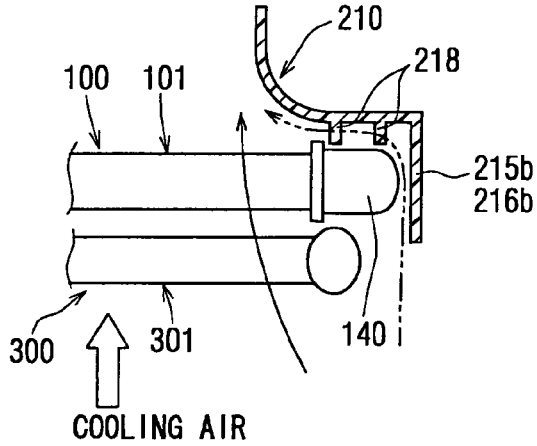
FIG. 21 is a cross-sectional view of the same cooling module of FIG. 20, when taken along a different horizontal plane.

An eighth embodiment of the present invention is shown in FIGS. 20 and 21, in which air sealing performance between the radiator 100 and/or the condenser 300 and the shroud 210 is improved compared with the sixth embodiment shown in FIGS. 13 to 16.

As shown in FIG. 20, air sealing ribs 215*h* and 216*h* are respectively and integrally formed at the bottom mounting portion 215*a* and the top mounting portion 216*a* of the shroud 210. The air sealing ribs 215*h* and 216*h* are respectively arranged at upstream sides of the condenser 300 and the radiator 100 in a flow direction of the cooling air. The air sealing ribs 215*h* and 216*h* are inwardly extending in the vertical direction, so that each of the forward ends of the air sealing ribs 215*h* and 216*h* is positioned inside of the side plates 130 and 330 of the radiator 100 and the condenser 300.

As shown in FIG. 21, different air sealing ribs 218 are integrally formed with the shroud 210 at such positions facing to the tanks 140 of the radiator 100. The air sealing ribs 218 are horizontally extending from the shroud toward the tanks 140, to seal spaces between the shroud 210 and the tanks 140.

According to the above structure of the air sealing ribs 215*h* and 216*h*, an air flow of the cooling air, which would bypass the core portions 301 and 101 of the condenser 300 and the radiator 100 and flow through the spaces between the bottom and top mounting portion 215*a* and 216*a* and the condenser 300 and the radiator 100, as indicated by dotted lines in FIG. 20, can be prevented or minimized.

Furthermore, according to the structure of the air sealing ribs 218, an air flow of the cooling air, which would flow through the spaces between the shroud 210 and the tanks 140 of the radiator 100, as indicated by a two-dot-chain line in FIG. 21, can be likewise prevented or minimized.

As above, the cooling air can be effectively guided to the core portions 301 and 101 of the condenser 300 and the radiator 100, to improve their heat exchange performances. Since the air sealing ribs 215*h* and 216*h* may not become in contact with the radiator 100 and the condenser 300, the assembling process of the radiator and the condenser to the shroud may not be adversely affected.

Figure 22:
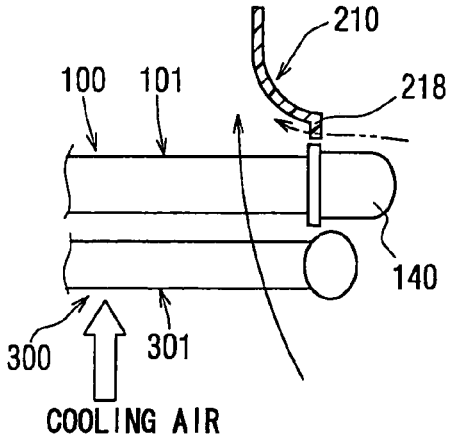
FIG. 22 is also a cross-sectional view of a cooling module according to a modification of the eighth embodiment.

A modification of the eighth embodiment is shown in FIG. 22, in which the side wall portions 215*b* or 216*b* are not formed at the shroud 210 (the lower and upper frames 215 and 216 of the shroud 210).

In this modification, a forward end 218 of the shroud 210 is extended toward the tanks 140 of the radiator 100, to form the air sealing ribs, like as the ribs 218 in FIG. 21.

Ninth Embodiment

Figure 23:
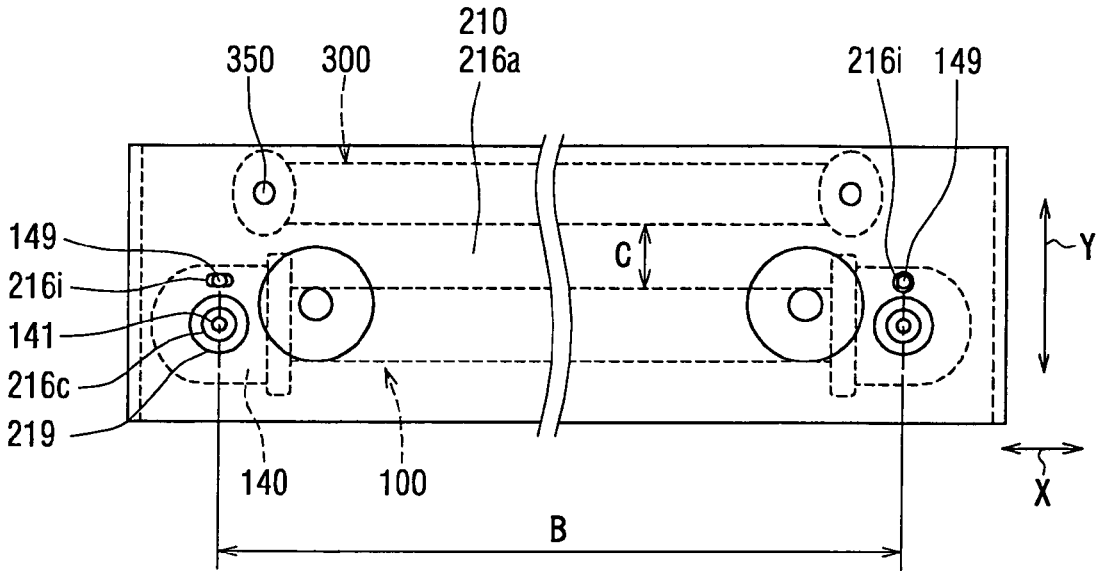
FIG. 23 is a top plan view showing a cooling module according to a ninth embodiment.
Figure 24:
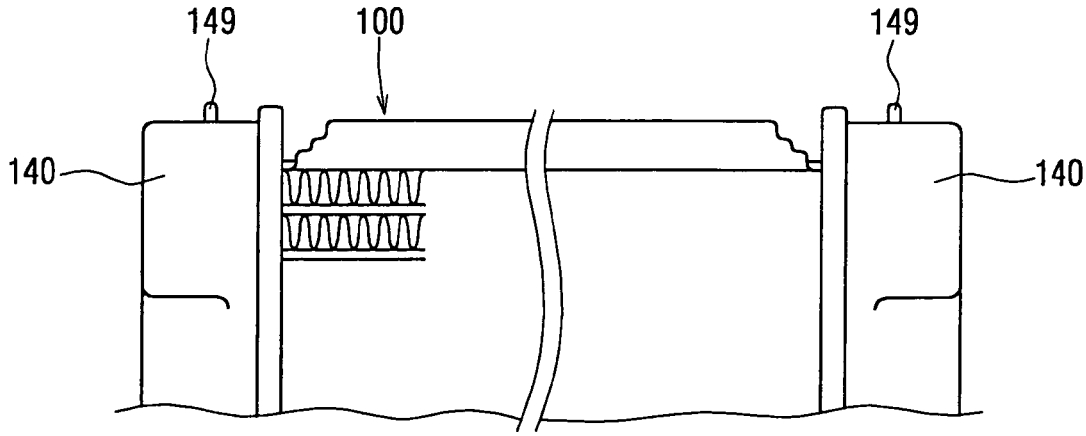
FIG. 24 is a front view of a radiator according to the ninth embodiment.

A ninth embodiment of the present invention is shown in FIGS. 23 and 24, in which concave-convex portions are formed at the radiator 100 and the shroud 210, to suppress displacement among the radiator 100, the condenser 300 and the shroud 210 during their assembling processes.

Multiple limit pins 149 are formed at vertical ends of the tanks 140 adjacent to the screw nut portions 141. Four limit pins 149 are formed in this embodiment and a diameter of the limit pins 149 is made to be 4.0 mm.

Multiple (four) limit holes 216*i* are likewise formed in the shroud, namely two limit holes 216*i* are formed in the top mounting portion 216*a* and other two limit holes are formed in the bottom mounting portion (215*a*). Those limit holes 216*i* are formed at such positions, at which centers of the limit holes 216*i* come on a line connecting centers of the both limit pins 149 of the radiator 100, when the top mounting portion 216*a* of the shroud 210 is placed at such a position at which centers of the metal collars 219 are on a line connecting centers of the screw nuts 141 of the radiator 100.

One of the limit holes 216*i* (for example, the right-hand limit hole 216*i* on the top portion 216*a*) is a reference position hole, having an inner diameter of 4.6 mm, whereas the other (left-hand) limit hole 216*i* is a hole for limiting a displacement of the shroud 210 with respect to the radiator 100 in a direction of assembling the cooling module 100B (as indicated by an arrow Y (an assembled direction) in FIG. 23). The other (left-hand) hole 216*i* is elongated in a direction (as indicated by an arrow X in FIG. 23) of a line connecting the two limit holes 216*i*, and has an inside dimension of 4.6×7.6 mm. The inside elongated length of 7.6 mm is so selected to tolerate variations of a distance (length B) between the limit pins 149 of the radiator 100.

When the cooling module 100B is assembled, the limit pins 149 are at first inserted into the limit holes 216*i*, and then the shroud 210 is fixed to the radiator 100 by inserting the bolts 400 through the collars 219 formed in the shroud 210 and screwed into the screw nut portions 141 formed on the radiator 100. The condenser 300 is fixed to the shroud 210, at the same time when the shroud 210 is fixed to the radiator 100, wherein the mounting pins 350 of the condenser 300 are inserted into the pin holes (216*d*) of the shroud 210.

The hole 216*c* (and 215*c*) formed by the collars 219, through which the bolt 400 is inserted for fixing the shroud 210 to the radiator 100, has an inner diameter larger than an outer diameter of the bolt 400 to tolerate the variations of the distance (length B) between the centers of the both collars 219 formed on the top mounting portion 216*a* (as well as the bottom mounting portion 215*a*). For example, in this embodiment, the inner diameter of the hole 216*c* (and 215*c*) is 10.0 mm, whereas the outer diameter of the bolt 400 is 6.0 mm.

In the case that the limit pins 149 and limit holes 216*i* were not provided, the maximum displacement of the shroud 210 with respect to the radiator 100 would be theoretically 4.0 mm in both directions X and Y.

According to the above ninth embodiment, however, the displacement of the shroud 210 with respect to the radiator 100 in the direction Y is limited by the engagement of the limit pins 149 with the limit holes 216*i*, the amount of the displacement in the direction Y is suppressed to a smaller amount (0.6 mm=4.6 mm−4.0 mm). As a result, a displacement of the condenser 300 with respect to the radiator 100 in the direction Y is likewise limited to the smaller amount (substantially equal to the displacement amount of the shroud 210 with respect to the radiator 100). Accordingly, the cooling module 100B has a smaller variation in its length of the direction Y, which is preferable when the cooling module 100B is mounted into the limited space of the engine compartment.

In the above embodiments, the screw nut portions 141, the limit pins 149, and the limit holes 216*i* are formed at the vertical ends of the tanks 140. It is, however, also possible to form those screw nut portions, limit pins, and the limit holes at horizontal side surface portions of the tanks 140, additionally to or instead of those elements at the vertical ends, so that the displacement in the vertical direction can be likewise limited to the smaller amount.

What is claimed is:

1. A cooling module to be mounted to a vehicle comprising:

a first heat exchanger having;

a pair of tanks, each extending in a vertical direction;

multiple female screw nut portions extending into the tanks;

a core portion having multiple tubes and fins alternately stacked in a vertical direction, both side ends of the tubes being connected to the tanks so that fluid flows from one of the tanks to the other one of the tanks through the multiple tubes; and a shroud, which is fixed to a side of the first heat exchanger, and which is divided into two parts in the vertical direction so that the shroud comprises an upper frame and a lower frame; wherein the upper frame has a top mounting portion arranged above the first heat exchanger and fixed to the first heat exchanger for guiding cool air toward the core portion of the first heat exchanger, the upper frame defining multiple upper mounting pins with which the cooling module is mounted to the vehicle, the upper frame being fixed to the tanks by fixing means screwed into respective female screw nut portions provided in the tanks;

the lower frame, which is formed as a separate member from the upper frame, has a bottom mounting portion arranged below the first heat exchanger and fixed to the first heat exchanger for guiding cool air toward the core portion of the first heat exchanger, the lower frame defining multiple lower mounting pins with which the cooling module is mounted to the vehicle, the lower frame being fixed to the tanks by fixing means screwed into respective female screw nut portions provided in the tanks; and the cooling module further comprises a second heat exchanger tightly held between the top and bottom mounting portions of the shroud, and the second heat exchanger is arranged at a position close to the first heat exchanger but at an opposite side from the shroud.

2. The cooling module according to claim 1, further comprising:

a pair of air guide plates fixed to at least one of the shroud and the first heat exchanger, the air guide plates extending toward a front end of the vehicle for guiding the cooling air toward the core portion of the first heat exchanger.

3. The cooling module according to claim 2, wherein the air guide plates are made as independent parts from the tanks and the shroud.

4. The cooling module according to claim 1, wherein the second heat exchanger comprises:

a pair of header tanks; and multiple mounting pins formed at vertical ends of the header tanks, wherein the mounting pins of the header tanks are inserted into mounting holes respectively formed at the top and bottom mounting portions of the shroud, so that the second heat exchanger is tightly held by the shroud.

5. The cooling module according to claim 1, wherein the tanks of the first heat exchanger are made of a resin.

6. The cooling module according to claim 2, wherein the shroud comprises air sealing ribs horizontally extending toward the first heat exchanger so that air flow of the cooling air through spaces between the first heat exchanger and the shroud is suppressed.

7. The cooling module according to claim 1, wherein the shroud is made of a resin, each of the top and bottom mounting portions of the shroud has metal collars to form mounting holes, through which the fixing means are inserted and screwed into the female screw nut portions formed in the tanks, and multiple limit pins and multiple limit holes are respectively formed at the tanks and the top and bottom mounting portions of the shroud, the limit pins and the limit holes being engaged with each other to limit a displacement of the shroud with respect to the first heat exchanger in a direction of assembling the first heat exchanger and a second heat exchanger.

* * * * *

UNITED STATES PATENT AND TRADEMARK OFFICE

CERTIFICATE OF CORRECTION

PATENT NO. : 7,640,966 B2
APPLICATION NO. : 11/005571
DATED : January 5, 2010
INVENTOR(S) : Maeda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 760 days.

Signed and Sealed this

Sixteenth Day of November, 2010

David J. Kappos

David J. Kappos
*Director of the United States Patent and Trademark Office*